US010234791B2

(12) United States Patent
Eto

(10) Patent No.: US 10,234,791 B2
(45) Date of Patent: Mar. 19, 2019

(54) DEVELOPER STORAGE CONTAINER AND IMAGE FORMING APPARATUS INCLUDING THE SAME

(71) Applicant: KYOCERA Document Solutions Inc., Osaka-shi (JP)

(72) Inventor: Daisuke Eto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/996,867

(22) Filed: Jun. 4, 2018

(65) Prior Publication Data

US 2018/0356749 A1 Dec. 13, 2018

(30) Foreign Application Priority Data

Jun. 7, 2017 (JP) ..... 2017-112573

(51) Int. Cl.
*G03G 15/08* (2006.01)

(52) U.S. Cl.
CPC ..... *G03G 15/0868* (2013.01); *G03G 15/0889* (2013.01); *G03G 2215/0685* (2013.01)

(58) Field of Classification Search
CPC ..... G03G 15/0868; G03G 15/0877; G03G 15/0889; G03G 15/0891; G03G 2215/0685
See application file for complete search history.

(56) References Cited

U.S. PATENT DOCUMENTS

2015/0185661 A1 7/2015 Eto
2016/0033903 A1* 2/2016 Eto ..... G03G 15/0867 399/262
2016/0062268 A1* 3/2016 Nakaue ..... 399/262
2016/0223945 A1* 8/2016 Hayashi ..... G03G 15/0865
2017/0176889 A1* 6/2017 Bejat ..... G03G 15/0889

FOREIGN PATENT DOCUMENTS

JP 2015-125333 7/2015

* cited by examiner

*Primary Examiner* — Sophia S Chen
(74) *Attorney, Agent, or Firm* — Gerald E. Hespos; Michael J. Porco; Matthew T. Hespos

(57) ABSTRACT

Provided are a developer storage container in which a large change of a developer distributed state due to a backward movement of a moving wall is restrained and an image forming apparatus provided with the developer storage container. A toner container includes a container body, a moving wall and a shaft. The moving wall includes a first wall portion and a second wall portion. When the shaft is rotated in a first rotating direction, the second wall portion presses the first wall portion, whereby the second wall portion moves in a first direction integrally with the first wall portion. When the shaft is rotated in a second rotating direction, the second wall portion relatively moves to an upstream side in the first direction with respect to the first wall portion.

6 Claims, 18 Drawing Sheets

DEVELOPER STORAGE CONTAINER AND IMAGE FORMING APPARATUS INCLUDING THE SAME

This application is based on Japanese Patent Application No. 2017-112573 filed with the Japan Patent Office on Jun. 7, 2017, the contents of which are hereby incorporated by reference.

BACKGROUND

The present disclosure relates to a developer storage container for storing a developer and an image forming apparatus provided with the same.

Conventionally, a developer storage container provided in an image forming apparatus is known as the one for storing a developer. The image forming apparatus includes an image carrier, a developing device and the developer storage container. When the developer is supplied from the developing device to the image carrier, an electrostatic latent image formed on the image carrier is developed as a developer image. The developer storage container includes a developer discharge port and supplies a replenishing developer to a replenishing port provided in the developing device.

Further, a developer storage container is known which includes a moving wall configured to move along a shaft while conveying a developer toward a developer discharge port.

In this technique, the moving wall moves according to the rotation of the shaft by the engagement of an externally threaded portion provided on the outer peripheral surface of the shaft and an internally threaded portion provided in a bearing portion of the moving wall.

In such a developer storage container, the developer is distributed with a predetermined draft surface between the moving wall and the developer discharge port.

SUMMARY

A developer storage container according to one aspect of the present disclosure includes a container body, a moving wall and a shaft. The container body has an inner peripheral surface defining a tubular internal space extending along a first direction. The container body is formed with a developer discharge port open to communicate with the internal space and allowing a developer to be discharged. The moving wall moves in the first direction in the internal space while conveying the developer in the internal space toward the developer discharge port. The shaft is arranged to extend in the first direction in the internal space and rotatably supported in the container body. The shaft includes a first engaging portion spirally formed along the first direction on an outer peripheral surface. The moving wall includes a first wall portion and a second wall portion. The first wall portion has a first outer peripheral surface arranged in contact with the inner peripheral surface of the container body and a conveying surface defining a storage space for storing the developer together with the inner peripheral surface of the container body. The first wall portion is formed with a space portion allowing the insertion of the shaft. The second wall portion is fitted into the space portion of the first wall portion. The second wall portion includes a bearing portion configured such that the shaft is inserted therethrough, a second engaging portion arranged on an inner peripheral surface of the bearing portion and engageable with the first engaging portion, and a pressing portion configured to press the first wall portion in the first direction. The second wall portion moves in the first direction integrally with the first wall portion by the pressing portion pressing the first wall portion according to the engagement of the first and second engaging portions when the shaft is rotated in a first rotating direction. The second wall portion relatively moves to an upstream side in the first direction with respect to the first wall portion according to the engagement of the first and second engaging portions when the shall is rotated in a second rotating direction opposite to the first rotating direction.

DETAILED DESCRIPTION

Figure 1:
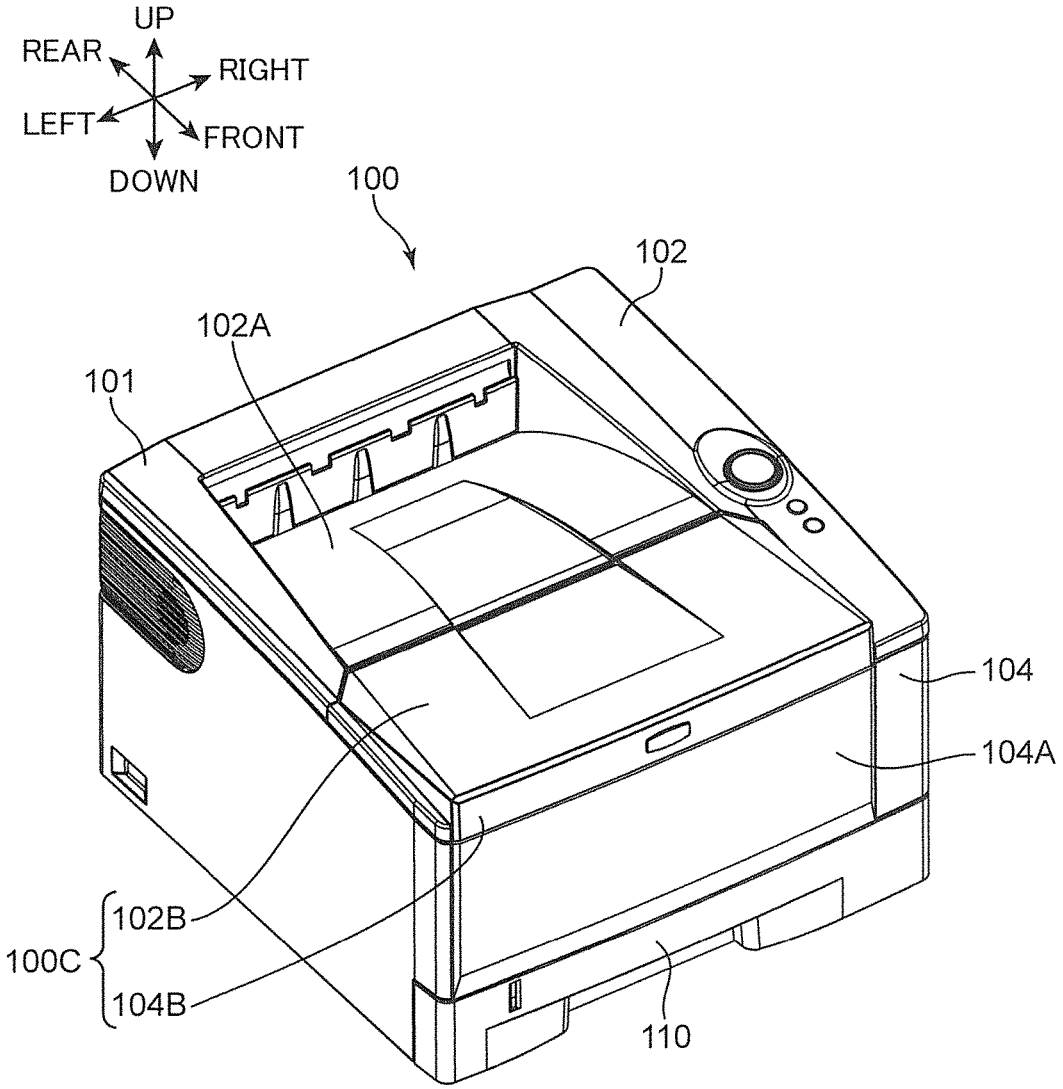
FIG. 1 is a perspective view showing an image forming apparatus according to one embodiment of the present disclosure.
Figure 2:
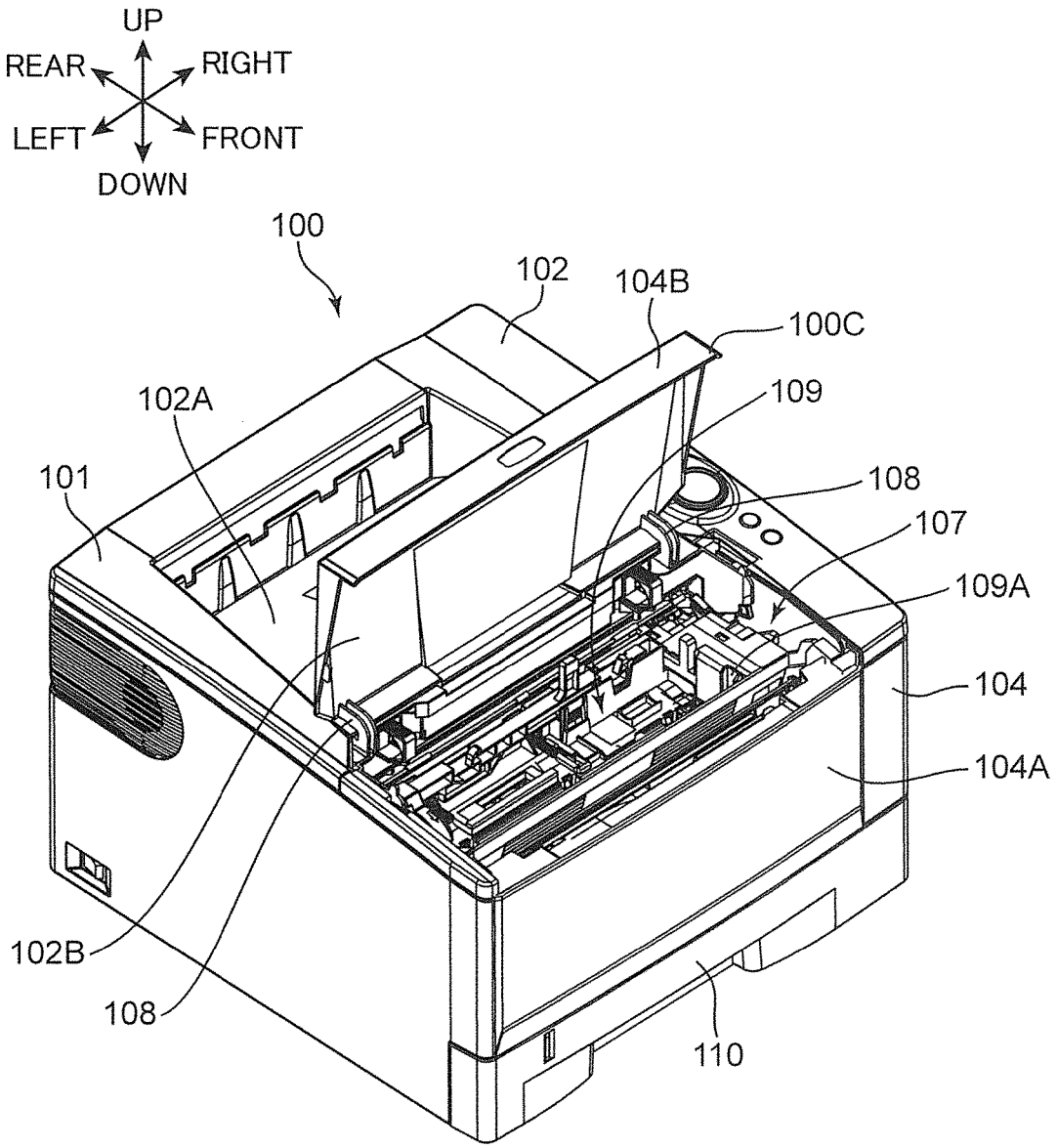
FIG. 2 is a perspective view of the image forming apparatus according to the embodiment of the present disclosure in a partially open state.
Figure 3:
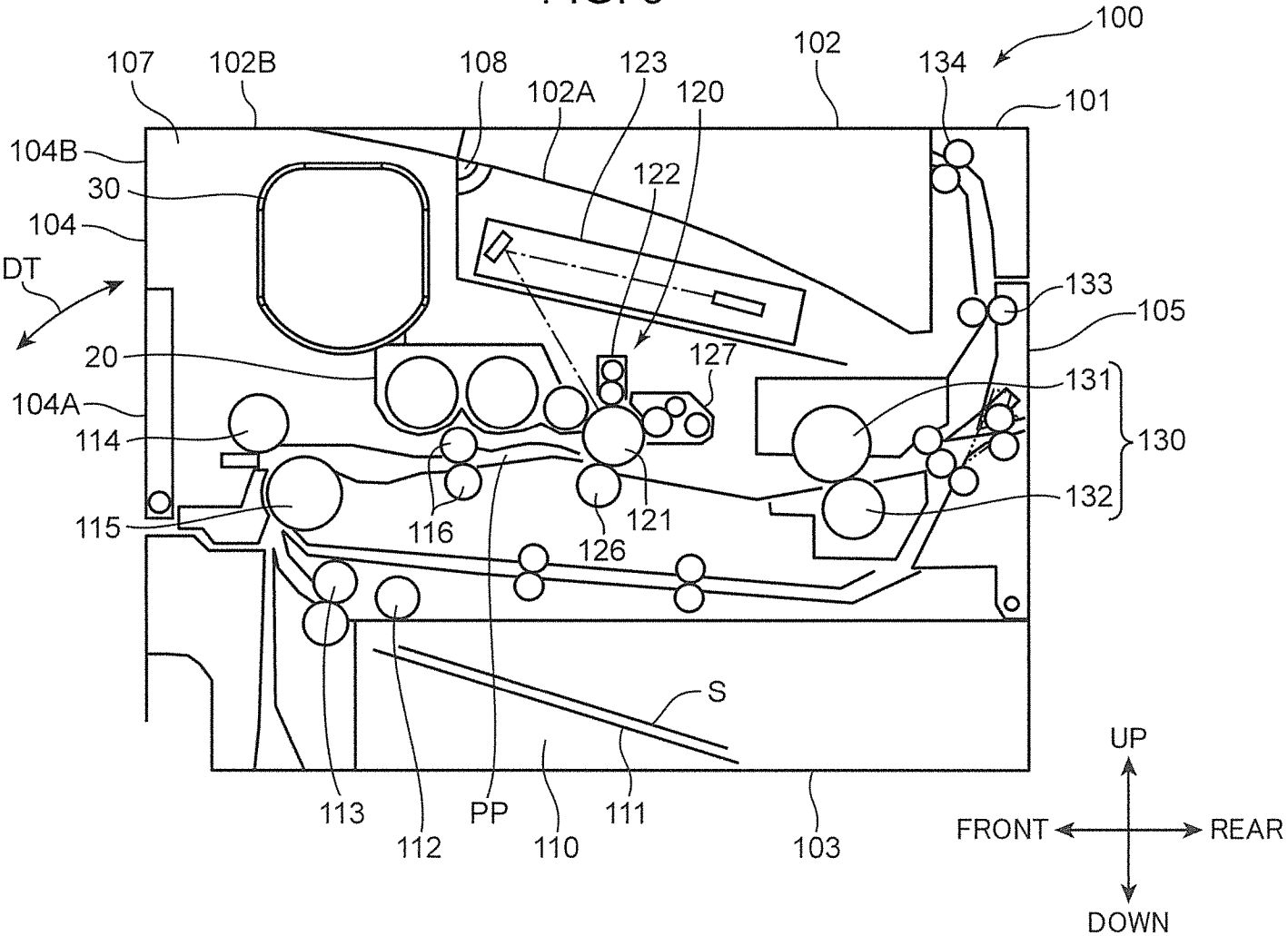
FIG. 3 is a schematic sectional view showing an internal structure of the image forming apparatus according to the embodiment of the present disclosure.

Hereinafter, one embodiment of the present disclosure is described with reference to the drawings. FIGS. 1 and 2 are perspective views of a printer 100 (image forming apparatus) according to the embodiment of the present disclosure. FIG. 3 is a sectional view schematically showing an internal structure of the printer 100 shown in FIGS. 1 and 2. The printer 100 shown in FIGS. 1 to 3 is a so-called monochrome printer. However, in another embodiment, the image forming apparatus may be a color printer, a facsimile machine, a complex machine provided with these functions or another apparatus for forming a toner image on a sheet. Note that direction-indicating terms such as "upper" and "lower", "front" and "rear", "left" and "right" used in the following description are merely for the purpose of clarifying the description and do not limit the principle of the image forming apparatus at all.

The printer 100 includes a housing 101 for housing various devices for forming an image on a sheet S. The housing 101 includes an upper wall 102 defining the upper surface of the housing 101, a bottom wall 103 (FIG. 3) defining the bottom surface of the housing 101, a body rear wall 105 (FIG. 3) between the upper wall 102 and the bottom wall 103 and a body front wall 104 located in front of the body rear wall 105. The housing 101 has a body internal space 107 in which various devices are arranged. A sheet conveyance path PP along which a sheet S is conveyed in a predetermined conveying direction extends in the body internal space 107 of the housing 101. Further, the printer 100 includes an access cover 100C to be openably and closably mounted on the housing 101.

The access cover 100C is composed of a front wall upper part 104B, which is an upper part of the body front wall 104, and an upper wall front part 102B, which is a front part of the upper wall 102. Further, the access cover 100C is openable and closable in a vertical direction with unillustrated hinge shafts arranged on a pair of arm portions 108 arranged on both end parts in a lateral direction as supporting points (FIG. 2). In an open state of the access cover 100C, an upper part of the body internal space 107 is opened to outside. On the other hand, in a closed state of the access cover 100C, the upper part of the body internal space 107 is closed.

A sheet discharge portion 102A is arranged in a central part of the upper wall 102. The sheet discharge portion 102A is formed of an inclined surface inclined downward from a front part to a rear part of the upper wall 102. A sheet S having an image formed thereon in an image forming unit 120 to be described later is discharged to the sheet discharge portion 102A. Further, a manual feed tray 104A is arranged in a vertically central part of the body front wall 104. The manual feed tray 104A is vertically rotatable about a lower end (arrow DT of FIG. 3).

With reference to FIG. 3, the printer 100 includes a cassette 110, a pickup roller 112, a first feed roller 113, a second feed roller 114, a conveyor roller 115, a pair of registration rollers 116, the image forming unit 120 and a fixing device 130.

The cassette 110 stores sheets S inside. The cassette 110 includes a lift plate 111. The lift plate 11 is inclined to push up the leading end edges of the sheets S. The cassette 110 can be pulled out forward with respect to the housing 101.

The pickup roller 112 is arranged above the leading end edges of the sheets S pushed up by the lift plate 111. When the pickup roller 112 rotates, the sheet S is pulled out from the cassette 110.

The first feed roller 113 is arranged downstream of the pickup roller 112 and feeds the sheet S to a further downstream side. The second feed roller 114 is arranged inwardly (rearwardly) of a pivot point of the manual feed tray 104A and pulls a sheet S on the manual feed tray 104A into the housing 101.

The conveyor roller 115 is disposed downstream of the first feed roller 113 and the second feed roller 114 in a sheet conveying direction. The conveyor roller 115 conveys the sheet S fed by the first and second feed rollers 113, 114 to a further downstream side.

The pair of registration rollers 116 function to correct the oblique feed of the sheet S. In this way, the position of an image to be formed on the sheet S is adjusted. The pair of registration rollers 116 feed the sheet S to the image forming unit 120 in accordance with an image formation timing by the image forming unit 120.

The image forming unit 120 includes a photoconductive drum 121 (image carrier), a charger 122, an exposure device 123, a developing device 20, a toner container 30 (developer storage container), a transfer roller 126 (transfer unit) and a cleaning device 127.

The photoconductive drum 121 has a cylindrical shape. The photoconductive drum 121 has a surface, on which an electrostatic latent image is to be formed, and carries a toner image (developer image) corresponding to the electrostatic latent image on the surface. The charger 122 has a predetermined voltage applied thereto and substantially uniformly charges the peripheral surface of the photoconductive drum 121. The exposure device 123 irradiates laser light to the peripheral surface of the photoconductive drum 121 charged by the charger 122. As a result, an electrostatic latent image corresponding to image data is formed on the peripheral surface of the photoconductive drum 121.

The developing device 20 supplies toner to the peripheral surface of the photoconductive drum 121 having an electrostatic latent image formed thereon. The toner container 30 supplies the toner (replenishing developer) to the developing device 20. The toner container 30 is disposed to be detachably attachable to the developing device 20. When the developing device 20 supplies the toner to the photoconductive drum 121, an electrostatic latent image formed on the peripheral surface of the photoconductive drum 121 is developed (visualized). As a result, a toner image (developer image) is formed on the peripheral surface of the photoconductive drum 121.

The transfer roller 126 is arranged below the photoconductive drum 121 to race the photoconductive drum 121 across the sheet conveyance path PP. A transfer nip portion is formed between the transfer roller 126 and the photoconductive drum 121, and the transfer roller 126 transfers the toner image to the sheet S. The cleaning device 127 removes the toner remaining on the peripheral surface of the photoconductive drum 121 after the toner image is transferred to the sheet S.

The fixing device 130 is arranged downstream of the image forming unit 120 in the conveying direction and fixes the toner image on the sheet S. The fixing device 130 includes a heating roller 131 for melting the toner on the sheet S and a pressure roller 132 for bringing the sheet S into close contact with the heating roller 131.

The printer 100 further includes a pair of conveyor rollers 133 disposed downstream of the fixing device 130 and a pair of discharge rollers 134 disposed downstream of the pair of conveyor rollers 133. The sheet S is conveyed upwardly by the pair of conveyor rollers 133 and finally discharged from the housing 101 by the pair of discharge rollers 134. The sheet S discharged from the housing 101 is stacked on the sheet discharge portion 102A.

<Concerning Developing Device>

Figure 4:
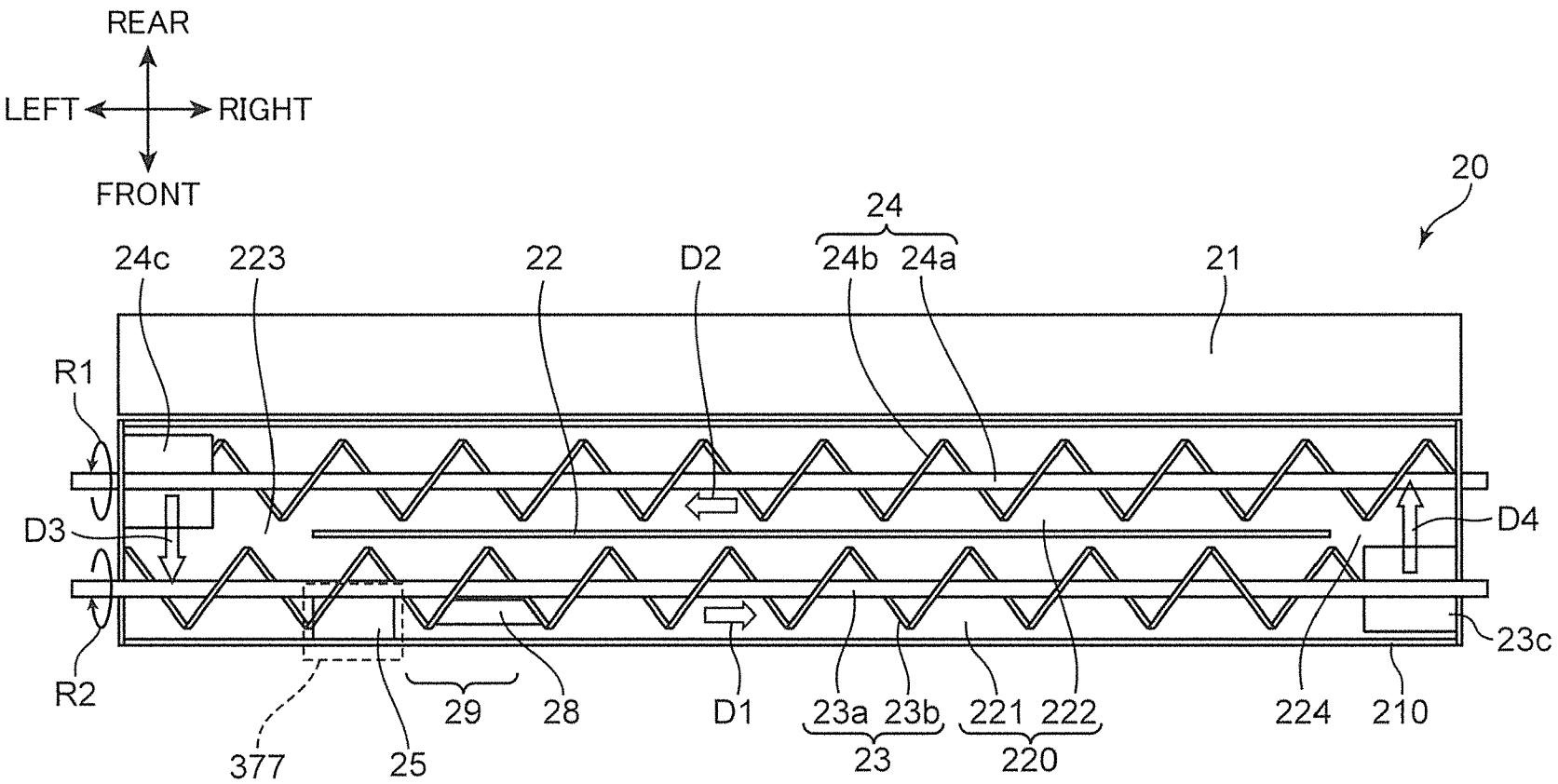
FIG. 4 is a schematic plan view showing the internal structure of developing device according to the embodiment of the present disclosure.

FIG. 4 is a plan view showing an internal structure of the developing device 20. The developing device 20 includes a development housing 210 (housing) having a box shape long in one direction (axial direction of a developing roller 21, lateral direction). The development housing 210 has a storage space (developer conveyance path) 220. The developing roller 21, a first stirring screw 23 (developer conveying member), a second stirring screw 24 and a toner replenishing port 25 are disposed in the storage space 220. In this embodiment, a one-component development method is applied and a toner is filled as a developer in this storage space 220. On the other hand, in the case of a two-component development method, a mixture of a toner and a carrier made of a magnetic material is filled as a developer. The toner is stirred and conveyed in the storage space 220 and successively supplied from the developing roller 21 to the photoconductive drum 121 to develop an electrostatic latent image.

The developing roller 21 has a cylindrical shape extending in a longitudinal direction of the development housing 210 and includes a sleeve part, which is rotationally driven, on an outer periphery. The storage space 220 of the development housing 210 is covered with an unillustrated top board and partitioned into a first conveyance path 221 and a second conveyance path 222 long in the lateral direction by a partition plate 22 extending in the lateral direction. The partition plate 22 is shorter than a lateral width of the development housing 210, and a first communication path 223 and a second communication path 224 allowing communication between the first and second conveyance paths 221, 222 are provided at left and right ends of the partition plate 22. In this way, a circulation path composed of the first conveyance path 221, the second communication path 224, the second conveyance path 222 and the first communication path 223 is formed in the storage space 220. The toner is conveyed counterclockwise in FIG. 4 in the circulation path.

The toner replenishing port 25 (developer replenishing port) is an opening open in the top board of the development housing 210, and arranged near and above the left end of the first conveyance path 221. The toner replenishing port 25 is arranged to face the above circulation path and has a function of receiving a replenishing toner (replenishing developer) supplied through a toner discharge port 377 (FIG. 4) of the toner container 30 into the storage space 220.

The first stirring screw 23 is disposed in the first conveyance path 221. The first stirring screw 23 includes a first rotary shaft 23*a* and a first spiral blade 23*b* spirally projecting on the periphery of the first rotary shaft 23*a*. The first stirring screw 23 conveys the toner in a direction of an arrow D1 of FIG. 4 by being rotationally driven about the first rotary shaft 23*a* (arrow R2). The first stirring screw 23 conveys the developer through a position where the toner replenishing port 25 faces the first conveyance path 221. In this way, the first stirring screw 23 has a function of conveying a new toner flowing in through the toner replenishing port 25 and the toner conveyed into the first conveyance path 221 from the second conveyance path 222 while mixing these toners. A first paddle 23*c* is disposed downstream of the first stirring screw 23 in a toner conveying direction (direction D1). The first paddle 23*c* is rotated together with the first rotary shaft 23*a* and transfers the toner from the first conveyance path 221 to the second conveyance path 222 in a direction of an arrow D4 of FIG. 4.

The second stirring screw 24 is disposed in the second conveyance path 222. The second stirring screw 24 includes a second rotary shaft 24*a* and a second spiral blade 24*b* spirally projecting on the periphery of the second rotary shaft 24*a*. The second stirring screw 24 supplies the toner to the developing roller 21 while conveying the toner in a direction of an arrow D2 of FIG. 4 by being rotationally driven about the second rotary shaft 24*a* (arrow R1). A second paddle 24*c* is disposed downstream of the second stirring screw 24 in a toner conveying direction (direction D2). The second paddle 24*c* is rotated together with the second rotary shaft 24*a* and transfers the toner from the second conveyance path 222 to the first conveyance path 221 in a direction of an arrow D3 of FIG. 4.

The toner container 30 (FIG. 3) is arranged above the toner replenishing port 25 of the development housing 210. The toner container 30 includes the toner discharge port 377 (FIG. 4). The toner discharge port 377 is disposed in a bottom portion 371 (FIG. 8B) of the toner container 30 to correspond to the toner replenishing port 25 of the developing device 20. The toner falling from the toner discharge port 377 is replenished into the developing device 20 through the toner replenishing port 25.

<Concerning Toner Replenishment>

Figure 5:
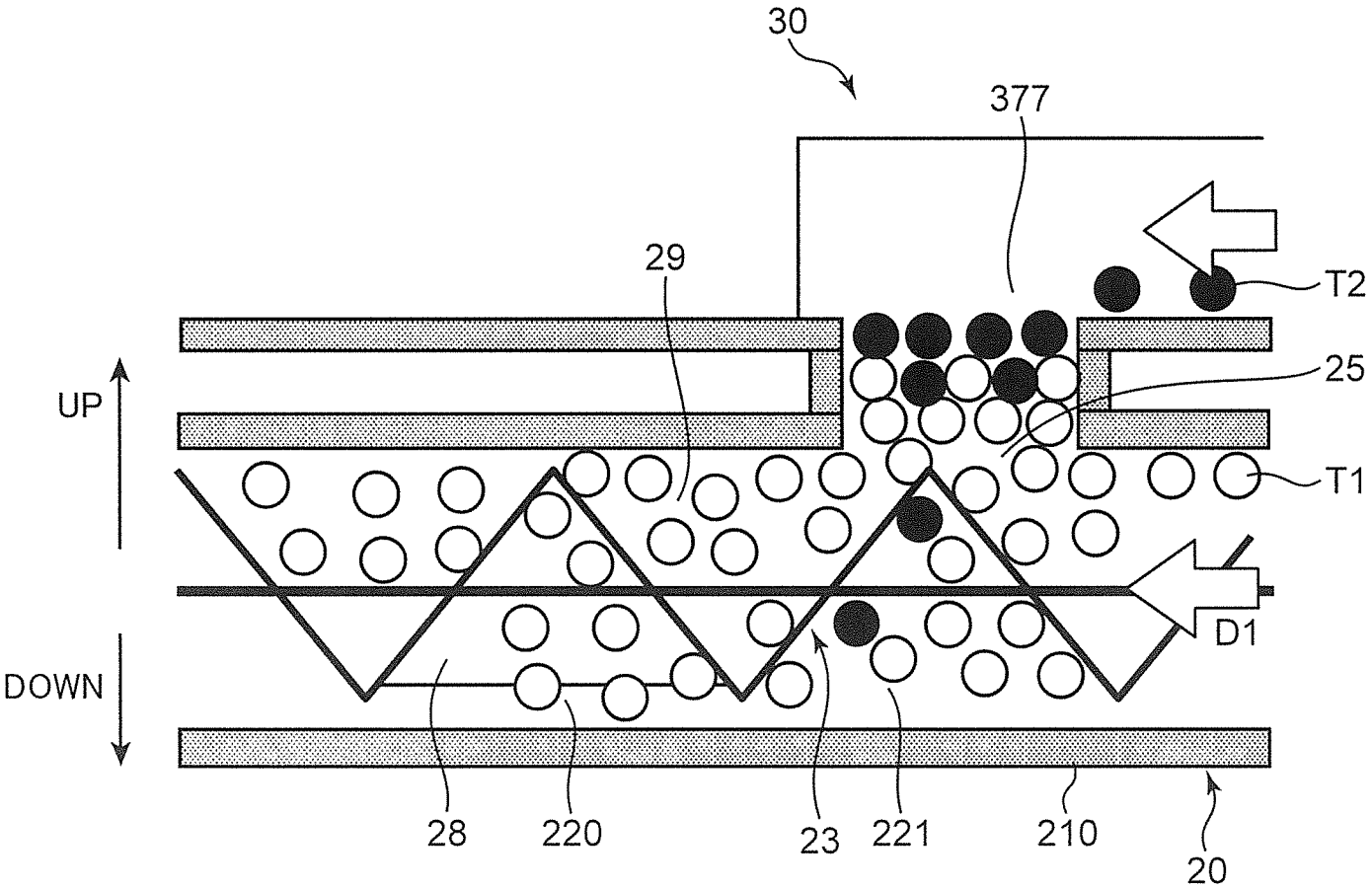
FIG. 5 is a schematic sectional view showing a state where a developer is replenished into the developing device according to the embodiment of the present disclosure.

Next, the flow of toner particles newly replenished through the toner replenishing port 25 is described. FIG. 5 is a sectional view near the toner replenishing port 25 disposed in the developing device 20 and the toner discharge port 377 disposed in the toner container 30.

Replenishing toner particles T2 supplied through the toner discharge port 377 of the toner container 30 fall into the first conveyance path 221 and are mixed with existing toner particles T1 and conveyed in the direction of the arrow D1 by the first stirring screw 23. At this time, the toner particles T1. T2 are stirred to be charged.

The first stirring screw 23 includes, on a side downstream of the toner replenishing port 25 in the toner conveying direction, a suppression paddle 28 (conveying ability suppressing portion) for partially suppressing a developer conveying ability. In this embodiment, the suppression paddle 28 is a plate-like member arranged between adjacent sections of the first spiral blade 23*b* of the first stirring screw 23. By the rotation of the suppression paddle 28 about the first rotary shaft 23*a*, the toner particles conveyed from a side upstream of the suppression paddle 28 start staying. The staying toner particles are accumulated up to a position which is immediately upstream of the suppression paddle 28 and where the toner replenishing port 25 faces the first conveyance path 221. As a result, a staying portion 29 of the developer (developer staying portion) is formed near an inlet of the toner replenishing port 25. Note that the first spiral blade 23*b* is arranged in an area facing the toner replenishing port 25 (FIG. 4). Further, in another embodiment, the conveying ability suppressing portion may be formed by an area where the first spiral blade 23*b* of the first stirring screw 23 is partially missing and the first rotary shaft 23*a* is partially exposed along an axial direction. Also in this configuration, the conveying ability of the first stirring screw 23 is partially suppressed, wherefore the staying portion of the developer is formed.

When the replenishing toner particles T2 are replenished through the toner replenishing port 25 and the amount of the toner particles in the storage space 220 increases, the toner particles staying in the staying portion 29 close (seal) the toner replenishing port 25 to suppress any further replenishment of the toner particles. Further, the first spiral blade 23*b* pushes the developer in the storage space 220 around the toner replenishing port 25 upwardly by being rotated. As a result, an action to seal the toner replenishing port 25 by the staying portion 29 is increased. Thereafter, when the toner particles in the storage space 220 are consumed by the developing roller 21 and the toner particles staying in the staying portion 29 decrease, the toner particles having closed the toner replenishing port 25 decrease to form a clearance between the staying portion 29 and the toner replenishing port 25. As a result, the replenishing toner particles T2 flow into the storage space 220 through the toner replenishing port 25 again. As just described, a volume replenishment type toner replenishing method of adjusting a receiving amount of the replenishing toner particles as the toner particles staying in the staying portion 29 decrease is adopted in this embodiment. Thus, the toner particles can be replenished into the developing device 20 even without providing a sensor for detecting a toner amount in the development housing 210 of the developing device 20.

<Concerning Attachment of Toner Container to Developing Device>

Figure 6:
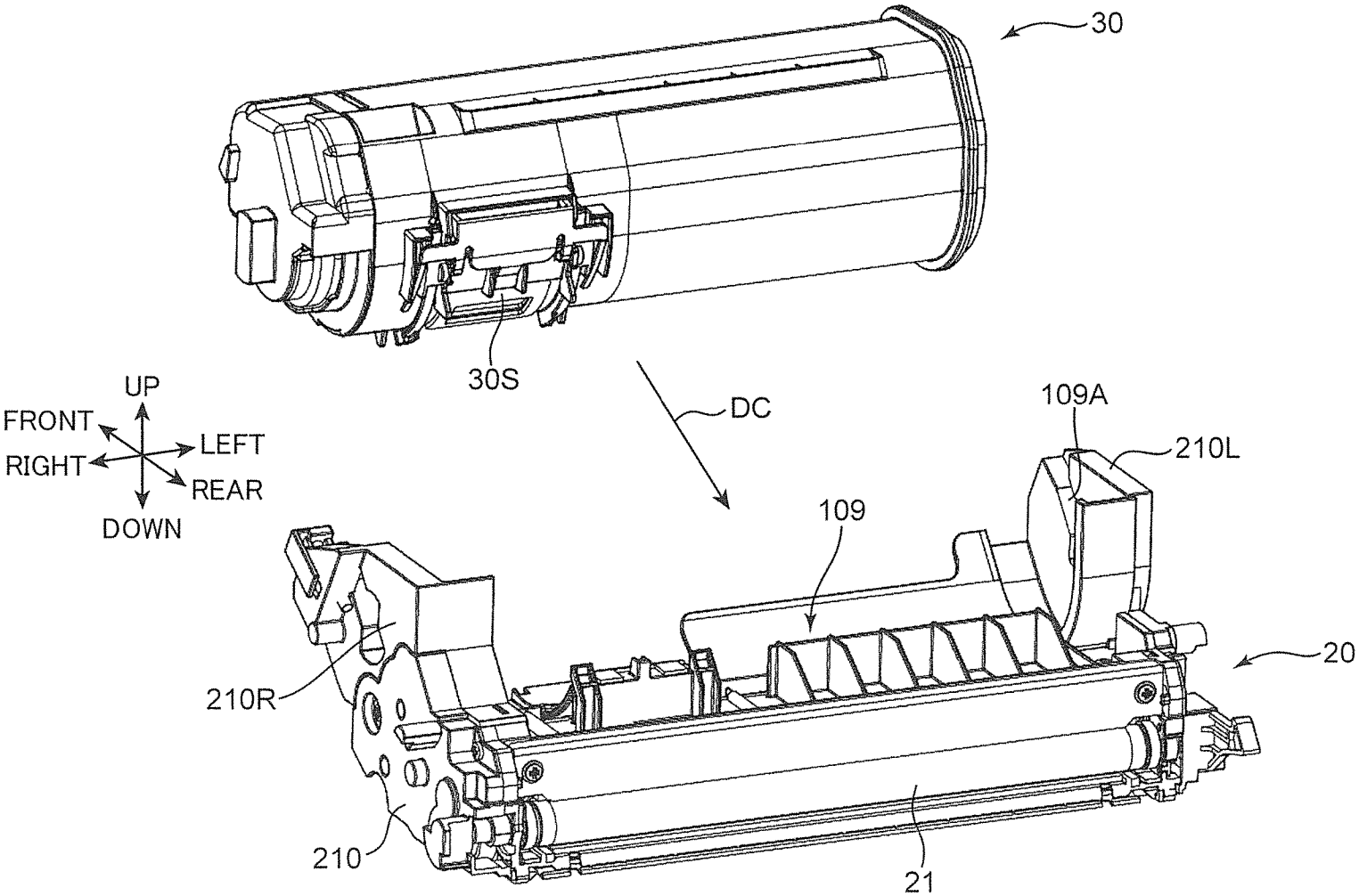
FIG. 6 is a perspective view of a developer storage container and the developing device according to the embodiment of the present disclosure.
Figure 7:
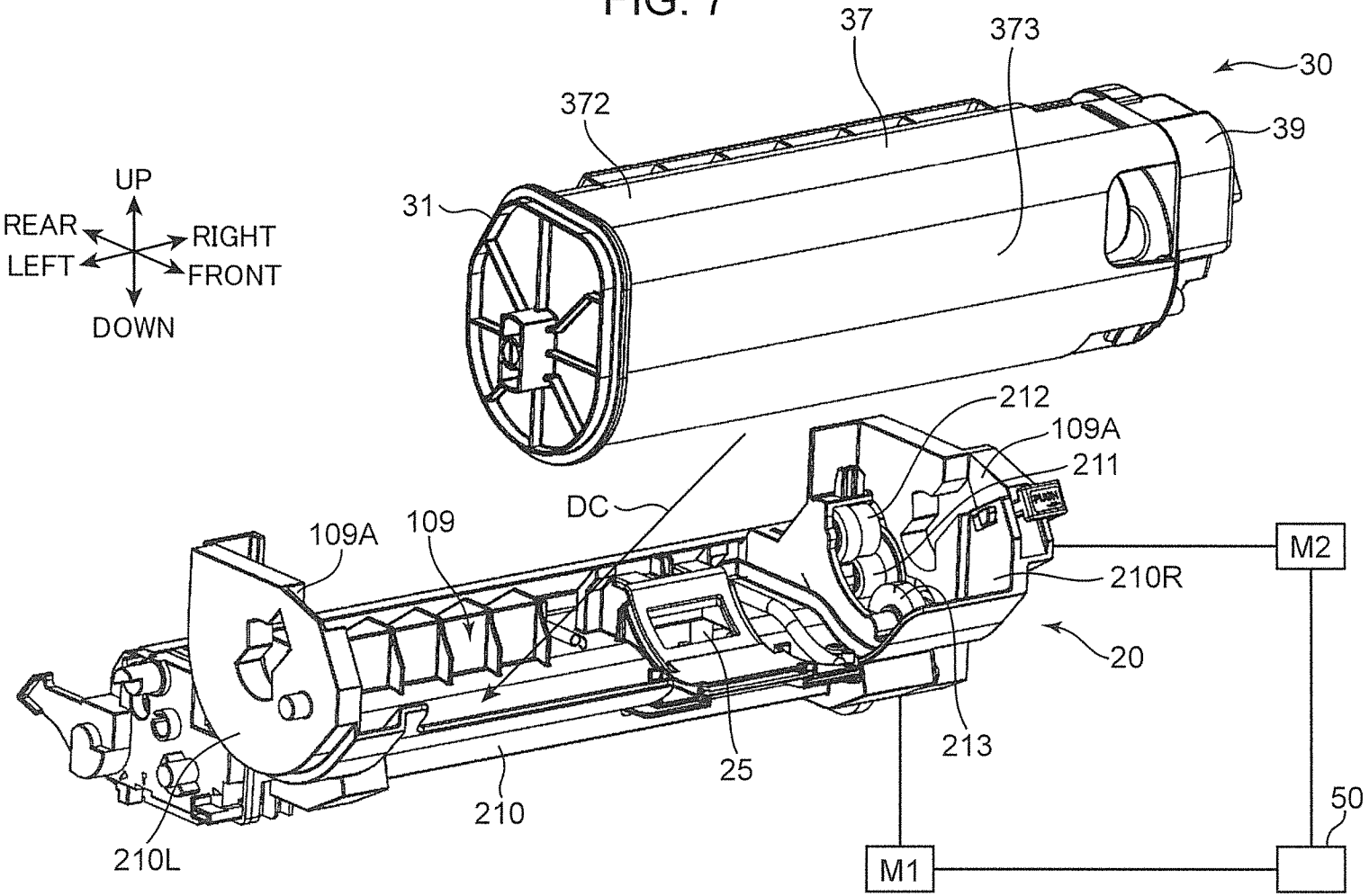
FIG. 7 is a perspective view of the developer storage container and the developing device according to the embodiment of the present disclosure.

FIGS. 6 and 7 are perspective views of the toner container 30 and the developing device 20 according to this embodiment. The toner container 30 is attachable to and detachable from the developing device 20 in the housing 101. With reference to FIG. 2, when the access cover 100C of the housing 101 is opened upwardly, a container storing portion 109 provided in the development housing 210 of the developing device 20 is exposed to the outside of the housing 101. With reference to FIGS. 6 and 7, the development housing 210 includes a pair of a housing left wall 210L and a housing right wall 210R. The container storing portion 109 is formed between the housing left wall 210L and the housing right wall 210R. In this embodiment, the toner container 30 is mounted into the container storing portion 109 substantially from above (see arrow DC of FIGS. 6 and 7). At this time, a later-described cover 39 of the toner container 30 is arranged on the side of the housing right wall 210R, and a later-described lid portion 31 of the toner container 30 is arranged on the side of the housing left wall 210L. The development housing 210 includes a pair of guide grooves 109A (FIG. 7). The guide grooves 109A are groove parts formed in the housing left wall 210L and the housing right wall 210R.

Further, with reference to FIG. 7, the developing device 20 includes a first transmission gear 211, a second transmission gear 212 and a third transmission gear 213. Further, the printer 100 includes a first motor M1, a second motor M2 and a controller 50 provided in the housing 101. The first, second and third transmission gears 211, 212 and 213 are gears rotatably supported on the housing right wall 210R. The first transmission gear 211 is coupled to the second transmission gear 212. Further, the first transmission gear 211 is coupled to the developing roller 21, the first stirring screw 23 and the second stirring screw 24 via an unillustrated gear group. When the developing device 20 is mounted into the housing 101, the first motor M is coupled to the third transmission gear 213 and the second motor M2 is coupled to the first transmission gear 211.

The first motor M1 moves a later-described moving wall 32 of the toner container 30 by rotating a later-described shaft 33 of the toner container 30 via the third transmission gear 213. The second motor M2 rotates the developing roller 21, the first stirring screw 23 and the second stirring screw 24 of the developing device 20 via the first transmission gear 211. Further, the second motor M2 rotates a later-described stirring member 35 of the toner container 30 via the first and second transmission gears 211, 212. The controller 50 controls each of the first and second motors M1, M2 to drive the respective members of the developing device 20 and the toner container 30 in a printing operation and the like of the printer 100.

<Concerning Structure of Toner Container>

Figures 8A, 8B:
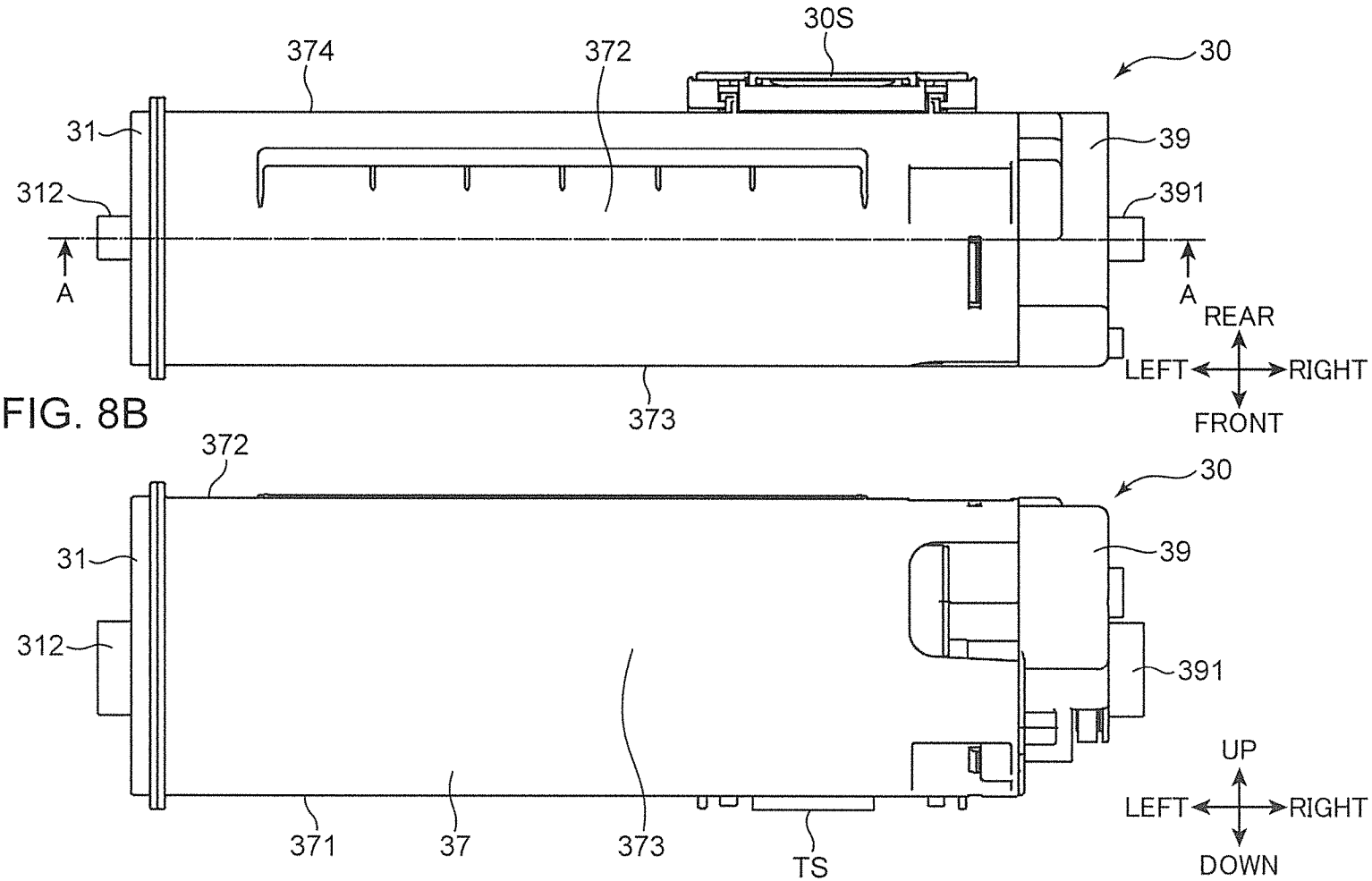
FIG. 8A is a plan view of the developer storage container according to the embodiment of the present disclosure and FIG. 8B is a front view of the developer storage container.
Figure 9:
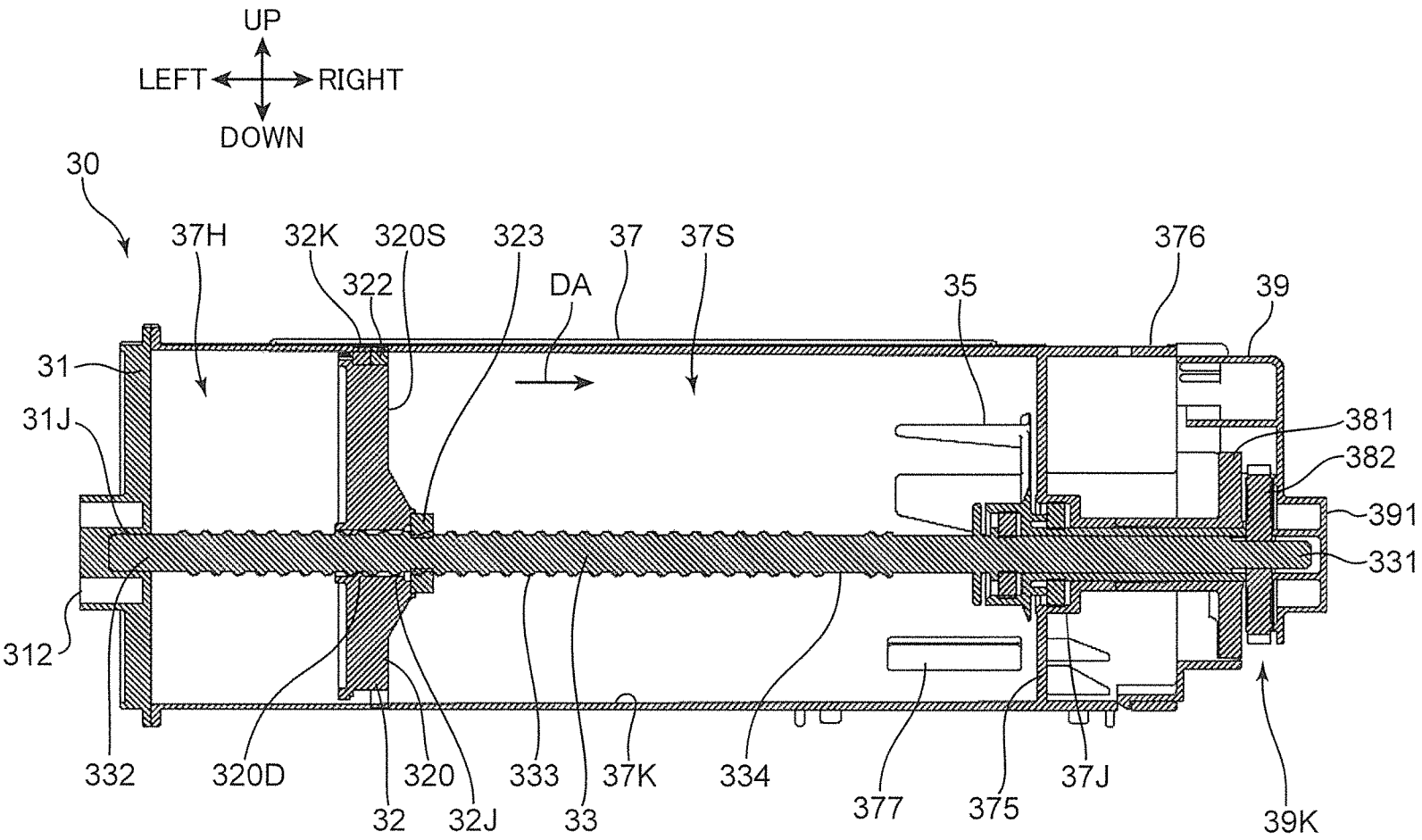
FIG. 9 is a sectional view of the developer storage container according to the embodiment of the present disclosure.
Figure 10:
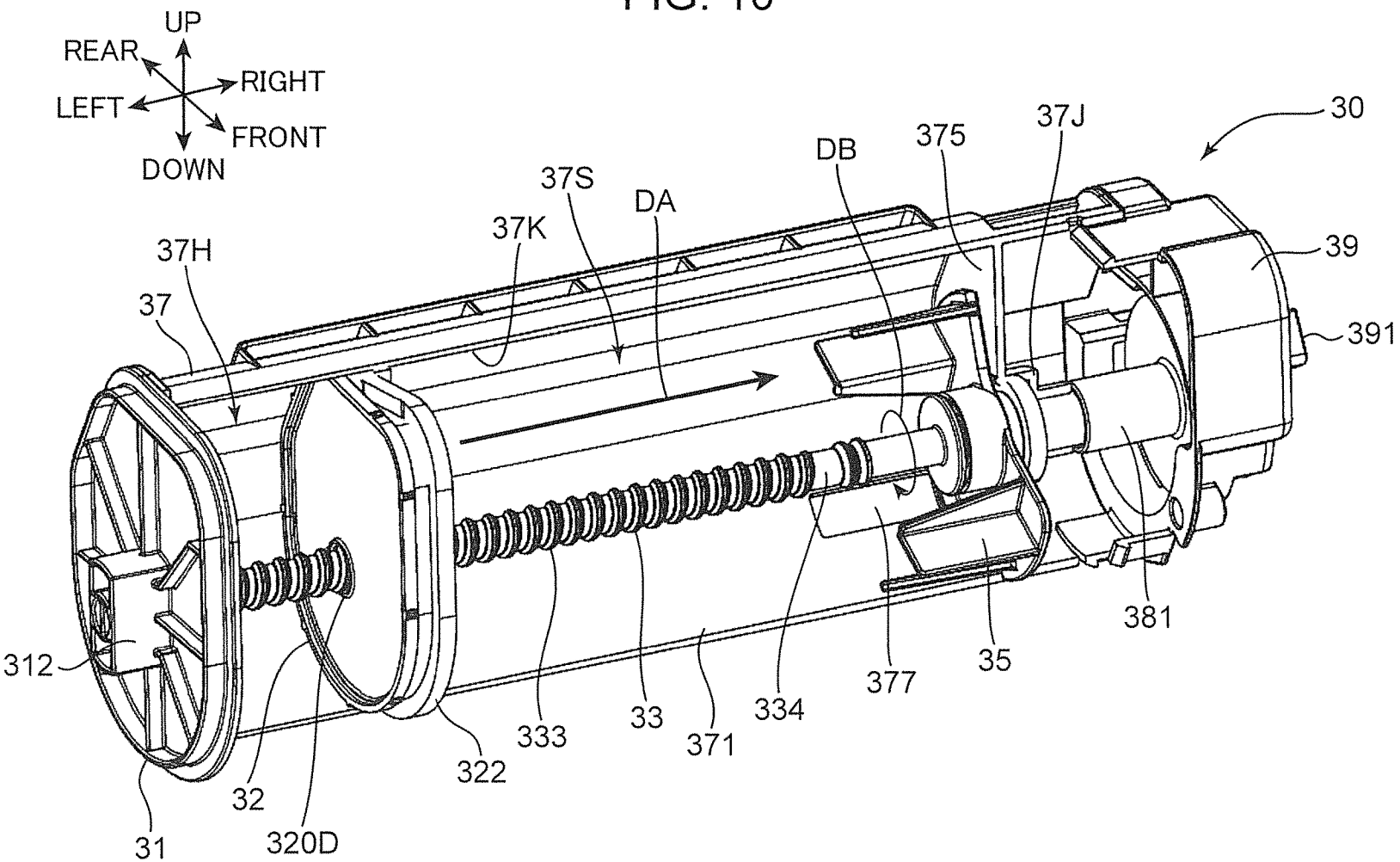
FIG. 10 is a perspective view showing an internal state of the developer storage container according to the embodiment of the present disclosure.
Figure 11:
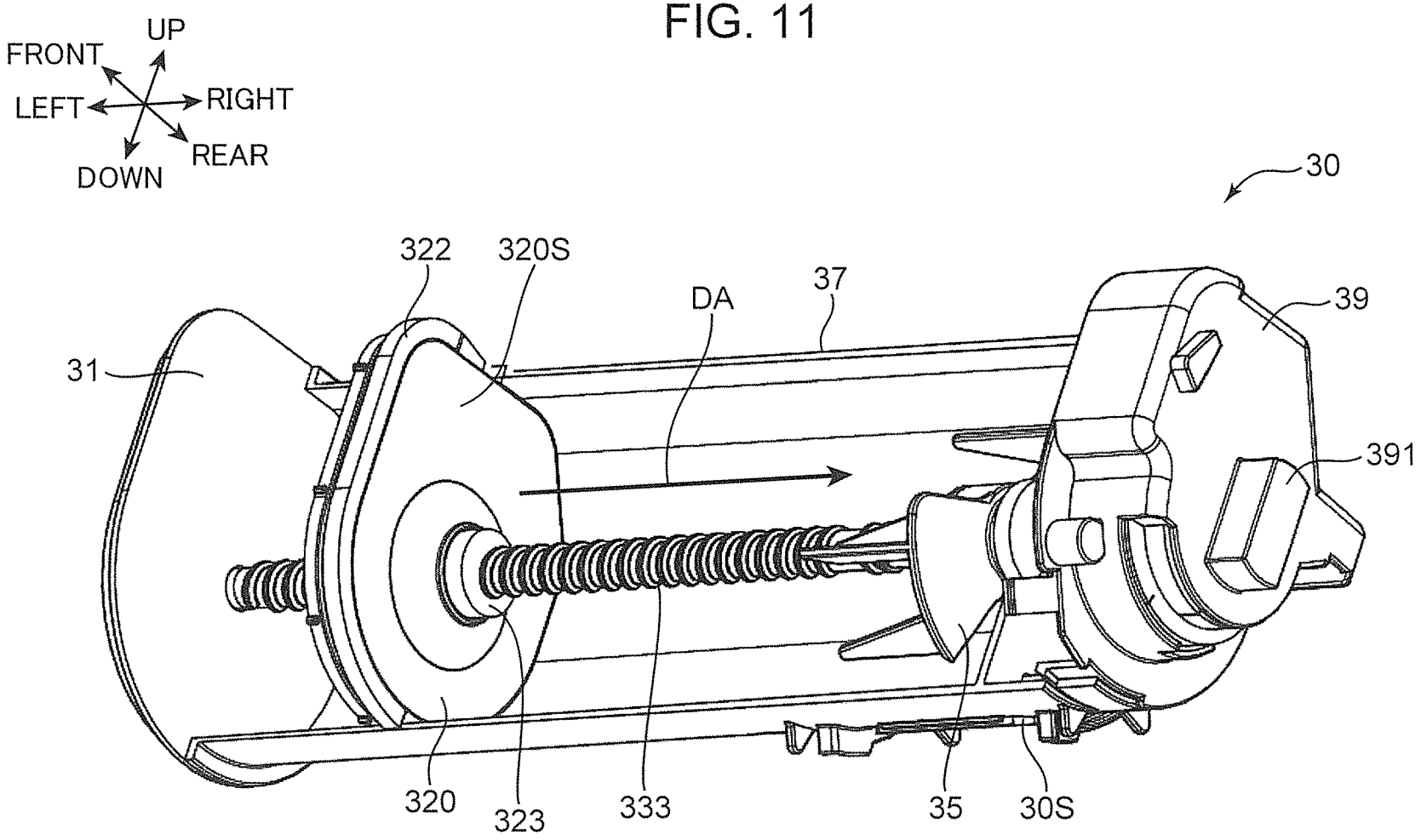
FIG. 11 is a perspective view showing the internal state of the developer storage container according to the embodiment of the present disclosure.

Next, the toner container 30 (developer storage container) according to one embodiment of the present disclosure is described with reference to FIGS. 8A to 11. FIGS. 8A and 8B are a plan view and a front view of the toner container 30 according to this embodiment. FIG. 9 is a sectional view of the toner container 30 at position A-A of FIG. 8A. FIGS. 10 and 11 are perspective views showing an internal state of the toner container 30 according to this embodiment. Note that FIGS. 10 and 11 are perspective views in which a later-described container body 37 of the toner container 30 is partially missing.

The toner container 30 has a tubular shape extending in the lateral direction (first direction, direction of an arrow DA of FIG. 9). The toner container 30 stores the replenishing toner (developer) inside. The toner container 30 includes the lid portion 31, the moving wall 32, the shaft 33, the stirring member 35, the container body 37, a toner sensor TS (FIG. 8B), a first gear 381 (FIG. 9), a second gear 382 and the cover 39.

The lid portion 31 (FIGS. 9, 10) is fixed to the container body 37 to seal an opening of the container body 37. The lid portion 31 includes a lid shaft hole portion 31J and a first guide portion 312 (FIGS. 9, 11). The lid shaft hole portion 31J is provided in a central part of the lid portion 31 and rotatably supports the shaft 33. The first guide portion 312 is a projection formed to extend in the vertical direction on a left side surface (outer surface part) of the lid portion 31. The first guide portion 312 has a function of guiding the attachment of the toner container 30 to the developing device 20.

The container body 37 is a tubular body part of the toner container 30. The container body 37 has an inner peripheral surface 37K and an internal space 37H (FIGS. 9, 10). The inner peripheral surface 37K is an inner peripheral surface of the container body 37 and defines the tubular internal space 37H extending along the longitudinal direction (first direction, direction of the arrow DA of FIGS. 9 and 10) of the toner container 30.

Further, with reference to FIGS. 8A and 8B, the container body 37 includes the bottom portion 371, a top board 372, a front wall 373, a rear wall 374, a right wall 375 (FIG. 9) and a projecting wall 376 (FIG. 9). The bottom portion 371 is a bottom part of the container body 37 and has a semicircular tubular shape projecting downward. The front wall 373 and the rear wall 374 are a pair of side walls rising upward from lateral ends of the bottom portion 371. The top board 372 is arranged above the bottom portion 371 to cover the internal space 37H from above. The right wall 375 is a wall portion connected to one end sides (right end sides) of the bottom portion 371, the front wall 373, the rear wall 374 and the top board 372 in the first direction and closing the container body 37. Note that the internal space 37H is a space defined by the inner peripheral surface 37K formed by the bottom portion 371, the top board 372, the front wall 373 and the rear wall 374 and, further, the right wall 375 and the lid portion 31. Further, an area of the internal space 37H between the right wall 375 and the moving wall 32 serves as a storage space 37S. The storage space 37S is a space for storing the toner inside the toner container 30.

As shown in FIG. 9, a side of the container body 37 opposite to the right wall 375 in the first direction is open (opening). When the lid portion 31 is fixed to this opening, the lid portion 31 closes the internal space 37H of the container body 37. Note that the outer peripheral edge of the lid portion 31 is ultrasonically welded to the container body 37.

With reference to FIG. 9, the projecting wall 376 is a part of the outer peripheral surface of the container body 37 projecting further rightward than the right wall 375. The cover 39 is mounted on the projecting wall 376.

Further, the container body 37 includes the aforementioned toner discharge port 377 (developer discharge port), a shutter 30S (FIGS. 6, 8A) and a body bearing portion 37J (FIG. 9). The toner discharge port 377 communicates with the inner peripheral surface 37K (the internal space 37H) and is open in a lower surface part of the container body 37. As shown in FIG. 9, the toner discharge port 377 is open in the lower surface part of a right end part (one end part in the first direction) of the container body 37 to communicate with the internal space 37H. In other words, the toner discharge port 377 is arranged adjacent to the right wall 375 in the first direction. Further, the toner discharge port 377 is a rectangular opening having a predetermined length along the first direction and a predetermined width along an arcuate shape of the bottom portion 371. In this embodiment, the toner discharge port 377 is open at a position deviated rearward and upward along a circumferential direction from a lower end part of the bottom portion 371. The toner discharge port 377 allows the toner to be discharged from the storage space 37S toward the developing device 20.

In this embodiment, the internal space 37H of the container body 37 is formed by the bottom portion 371, the front wall 373, the rear wall 374 and the top board 372 as described above. Thus, the toner in the storage space 37S is collected into the bottom portion 371 having an arcuate shape by the weight thereof, wherefore the toner conveyed by the later-described moving wall 32 can be efficiently discharged through the toner discharge port 377.

The shutter 30S (FIG. 6) is slidably arranged on a right end part of the container body 37. The shutter 30S closes (seals) the toner discharge port 377 from the outside of the container body 37 and exposes the toner discharge port 377 to outside. A sliding movement of the shutter 30S is linked with an attaching operation of the toner container 30 to the developing device 20.

The body bearing portion 37J is a bearing formed in the right wall 375. The shaft 33 is inserted through the body bearing portion 37J. At this time, a right end side of the shaft 33 projects outwardly of the container body 37.

The moving wall 32 is a wall portion arranged to face in the first direction inside the container body 37 (internal space 37H). The moving wall 32 defines one end surface (left end surface) of the storage space 37S in the first direction. Note that the other end surface (right end surface) of the storage space 37S in the first direction is defined by the right wall 375. Further, the moving wall 32 has a function of moving in the first direction in the internal space 37H from an initial position on one end side to a final position on the other end side in the first direction while conveying the toner in the storage space 37S toward the toner discharge port 377 from the start to the end of use of the toner container 30. In this embodiment, the initial position of the moving wall 32 is arranged to the right of (downstream in the first direction) the lid portion 31 and the final position is arranged immediately to the left of (upstream in the first direction) of the toner discharge port 377.

With reference to FIGS. 9 to 11, the moving wall 32 includes a conveying wall portion 320, an inner wall seal 322, a shaft seal 323, a bearing portion 32J (FIG. 9) and an outer peripheral surface 32K (first outer peripheral surface). The outer peripheral surface 32K is arranged to face the inner peripheral surface 37K of the container body 37 and in contact with the inner peripheral surface 37K via the inner wall seal 322.

The conveying wall portion 320 is a wall portion defining the storage space 37S together with the inner peripheral surface 37K of the container body 37. Particularly, the conveying wall portion 320 has a conveying surface 320S perpendicular to the shaft 33. The conveying surface 320S conveys the toner in the storage space 37S while pressing the toner according to a movement of the moving wall 32. The conveying surface 320S defines the storage space 37S for storing the toner together with the inner peripheral surface 37K of the container body 37.

The bearing portion 32J is a bearing portion formed substantially in a central part of the conveying wall portion 320. The bearing portion 32J moves along the first direction while holding the moving wall 32. The later-described shaft 33 is inserted through this bearing portion 32J.

The bearing portion 32J includes an internally threaded portion 320D. The internally threaded portion 320D is spirally threaded portion formed on the inner peripheral surface of the bearing portion 32J. The internally threaded portion 320D has a function of moving the moving wall 32 along the first direction by being engaged with a later-described externally threaded portion 333 of the shaft 33.

The inner wall seal 322 is a seal member arranged along the outer peripheral surface 32K of the moving wall 32 on a side downstream of the moving wall 32 in the first direction. The inner wall seal 322 is arranged over the entire moving wall 32 in the circumferential direction. The inner wall seal 322 is an elastic member made of urethane sponge.

The inner wall seal 322 is compressed and deformed between the inner peripheral surface 37K of the container body 37 and the moving wall 32. The toner in the storage space 37S is prevented from flowing out from a space between the inner peripheral surface 37K of the container body 37 and the moving wall 32 to a side upstream of the moving wall 32 in a moving direction by the inner wall seal 322.

The shaft seal 323 is fixed to a side of the bearing portion 32J more forward than the internally threaded portion 320D in the moving direction of the moving wall 32 (FIG. 9). Since having a ring shape, the shaft seal 323 is held in close contact with the shaft 33 entirely in the circumferential direction of the shaft 33. Thus, the toner in the storage space 37S is prevented from flowing out to a side upstream of the moving wall 32 in the moving direction through the bearing portion 32J.

The shaft 33 is rotatably supported through the right wall 375 of the container body 37 and the lid portion 31 to extend in the first direction in the internal space 37H. The shaft 33 includes a first shaft end part 331, a second shaft end part 332, the externally threaded portion 333 and a moving wall stopping portion 334.

With reference to FIG. 9, the first shaft end part 331 is a tip part of the shaft 33 projecting rightward through the body bearing portion 37J. A pair of D surfaces are formed on the peripheral surface of the first shaft end part 331. A second gear 382 having a D hole in a central part is engaged with the first shaft end part 331. As a result, the shaft 33 and the second gear 382 are integrally rotatable. The second shaft end part 332 is a left end part of the shaft 33. The second shaft end part 332 is rotatably supported in the lid shaft hole portion 31J formed in the lid portion 31.

The externally threaded portion 333 (first engaging portion) is a spirally threaded portion formed along the first direction on the outer peripheral surface of the shaft 33 in the internal space 37H. In this embodiment, the externally threaded portion 333 is arranged from an area of the shaft 33 adjacent to the lid portion 31 to an area upstream of the toner discharge port 377 in the first direction (arrow DA of FIG. 10) as shown in FIG. 10.

The moving wall stopping portion 334 is continuously arranged on a side downstream of the externally threaded portion 333 in the first direction. The moving wall stopping portion 334 is an area formed only of a shaft part where the externally threaded portion 333 is partially missing on the shaft 33 in the internal space 37H. The moving wall stopping portion 334 is located above the toner discharge port 377 and upstream of the toner discharge port 377 in the first direction.

The stirring member 35 (FIG. 9) is arranged along the right wall 375 above the toner discharge port 377. The stirring member 35 stirs the toner in the storage space 37S and feeds the toner through the toner discharge port 377. In this embodiment, the stirring member 35 is relatively rotated about the shaft 33 with respect to the shaft 33. In FIG. 10, the stirring member 35 is rotated in a direction of an arrow DB.

The first gear 381 transmits a rotational drive force to the stirring member 35. The first gear 381 is coupled to the second motor M2 via the first and second transmission gears 211, 212 of the developing device 20 (FIG. 7). In this embodiment, the first gear 381 is rotationally driven in synchronization with the developing roller 21 and the first and second stirring screws 23, 24 of the developing device 20. The first gear 381 is coupled to the stirring member 35 passed through the body bearing portion 37J. As a result, the first gear 381 and the stirring member 35 integrally rotate.

The second gear 382 transmits a rotational drive force to the shaft 33. The second gear 382 is coupled to the first motor M1 via the third transmission gear 213 (FIG. 7). As shown in FIG. 9, a right end part of the shaft 33 is arranged through the stirring member 35. The second gear 382 is coupled (fixed) to a tip part (first shaft end part 331) of the shaft 33.

The cover 39 is mounted on the projecting wall 376 of the container body 37. The cover 39 has a function of exposing circumferential parts of the first and second gears 381, 382 to outside and covering other circumferential parts of the first and second gears 381, 382. With reference to FIG. 9, the cover 39 includes a second guide portion 391 and a gear opening 39K.

The second guide portion 391 is a projection projecting rightward along the vertical direction on a right side surface of the cover 39. The second guide portion 391 has a function of guiding the attachment of the toner container 30 to the developing device 20 together with the first guide portion 312 of the lid portion 31.

The gear opening 39K is an opening open in a lower surface part of the cover 39 and having a semicircular shape. When the cover 39 is mounted on the container body 37, some of gear teeth of the first and second gears 381, 382 are exposed to the outside of the toner container 30 via the gear opening 39K. As a result, when the toner container 30 is mounted in the development housing 210 of the developing device 20, the first and second gears 381, 382 are respectively engaged with an electromagnetic clutch connected to the second transmission gear 212 and the transmission gear 213 (FIG. 7).

The toner sensor TS (FIG. 8B) is a sensor fixed to the container body 37. The toner sensor TS is arranged above and adjacent to the toner discharge port 377 in the circumferential direction. The toner sensor TS is a sensor formed of a magnetic permeability sensor (magnetic sensor) or a piezoelectric element. If the toner sensor TS is formed of a piezoelectric element, a sensor part of the toner sensor TS is exposed to the storage space 37S. The toner sensor TS outputs a HIGH signal (+5 V) by being pressed by the toner in the storage space 37S. Further, if there is almost no toner above the toner sensor TS, the toner sensor TS outputs a LOW signal (0 V). An output signal of the toner sensor TS is referred to by the controller 50 (FIG. 7). Note that, if the toner sensor TS is a magnetic permeability sensor, the sensor needs not directly contact the toner. Thus, the toner sensor TS may be fixed to an outer wall of the container body 37. Further, in another embodiment, the toner sensor TS may be arranged on the side of the development housing 210 (device body side) of the developing device 20 to face the outer wall of the container body 37. Furthermore, the arrangement of the toner sensor TS is not limited to that on the rear wall 374. In another embodiment, a toner sensor may be arranged on the top board 372, the front wall 373, the bottom portion 371 or the like of the container body 37.

<Concerning Movement of Moving Wall>

The toner container 30 is mounted into the container storing portion 109 by a user while the first guide portion 312 of the lid portion 31 and the second guide portion 391 of the cover 39 are guided by the pair of guide grooves 109A of the developing device 20 (FIGS. 6, 7). When the toner container 30 is mounted into the container storing portion 109, the shutter 30S is moved to open the toner discharge port 377. As a result, the toner discharge port 377 is arranged to face the toner replenishing port 25 from above (FIGS. 4, 5).

Note that FIG. 10 is a sectional view showing a state while the moving wall 32 is moving in the first direction from the initial position. Further, the initial position of the moving wall 32 is set at a position along the lid portion 31. i.e. to the left of the position of the moving wall 32 shown in FIG. 9.

When a new toner container 30 is mounted in the printer 100, the controller 50 (FIG. 7) drives the first motor M1 to rotationally drive the shaft 33 via the second gear 382 engaged with the third transmission gear 213. As a result, the moving wall 32 moves toward the toner discharge port 377 in the first direction (arrow DA of FIG. 9) by the engagement of the externally threaded portion 333 of the shaft 33 and the internally threaded portion 320D of the moving wall 32. Eventually, when the moving wall 32 moves rightward from the initial position by a predetermined distance, the storage space 37S is filled with the toner and the toner sensor TS outputs a HIGH signal corresponding to a fully filled state. Upon receipt of the HIGH signal output from the toner sensor TS, the controller 50 stops the moving wall 32.

As described above, in this embodiment, the volume replenishment type toner replenishing method is adopted in this embodiment as shown in FIG. 5. Thus, if the staying portion 29 (FIG. 5) in the developing device 20 seals the toner replenishing port 25 from below, the replenishing toner does not fall from the toner container 30. On the other hand, if the toner is supplied from the developing roller 21 of the developing device 20 to the photoconductive drum 121 and the toner in the staying portion 29 decreases, the toner flows from the toner discharge port 377 into the developing device 20 via the toner replenishing port 25. As a result, the toner around the toner sensor TS is lost in the storage space 37S of the toner container 30, wherefore the toner sensor TS outputs a LOW signal. Upon receipt of this signal, the controller 50 drives the first motor M1 to further move the moving wall 32 toward the toner discharge port 377 until the toner sensor TS outputs a HIGH signal.

Note that the controller 50 drives the second motor M2 to rotationally drive the developing roller 21 and the like according to a developing operation in the developing device 20. In conjunction with this rotating operation, the stirring member 35 is rotated via the first gear 381 engaged with the second transmission gear 212. As a result, the stirring member 35 arranged on a right end side of the storage space 37S rotates about the shaft 33, wherefore the toner above the toner discharge port 377 is stably stirred. Thus, the fluidity of the toner increases and the toner stably falls through the toner discharge port 377.

When a printing operation is repeated and the toner in the storage space 37S of the toner container 30 is continuously used, the moving wall 32 eventually reaches the final position immediately before the toner discharge port 377. The moving wall 32 gradually moves in the first direction in this way, whereby the toner in the storage space 37S is conveyed to the toner discharge port 377 while being pressed by the moving wall 32. At this time, the storage space 37S is gradually reduced in size until the moving wall 32 reaches the final position. Thus, the space where the toner remains is gradually lost inside the toner container 30. As a result, the amount of the toner remaining in the storage space 37S of the container body 37 is reduced when use is finished as compared to conventional toner containers in which the volume of a storage space remains unchanged.

Note that, in this embodiment, the moving wall 32 is stopped at the final position slightly upstream of the toner discharge port 377 in the first direction. Specifically, when the bearing portion 32J of the moving wall 32 reaches the moving wall stopping portion 334 according to a movement of the moving wall 32, the externally threaded portion 333 and the internally threaded portion 320D are disengaged. As a result, a moving force is no longer transmitted from the shaft 33 to the moving wall 32 and the moving wall 32 stops at the final position.

<Concerning Separation Structure of Moving Wall>

Figure 12:
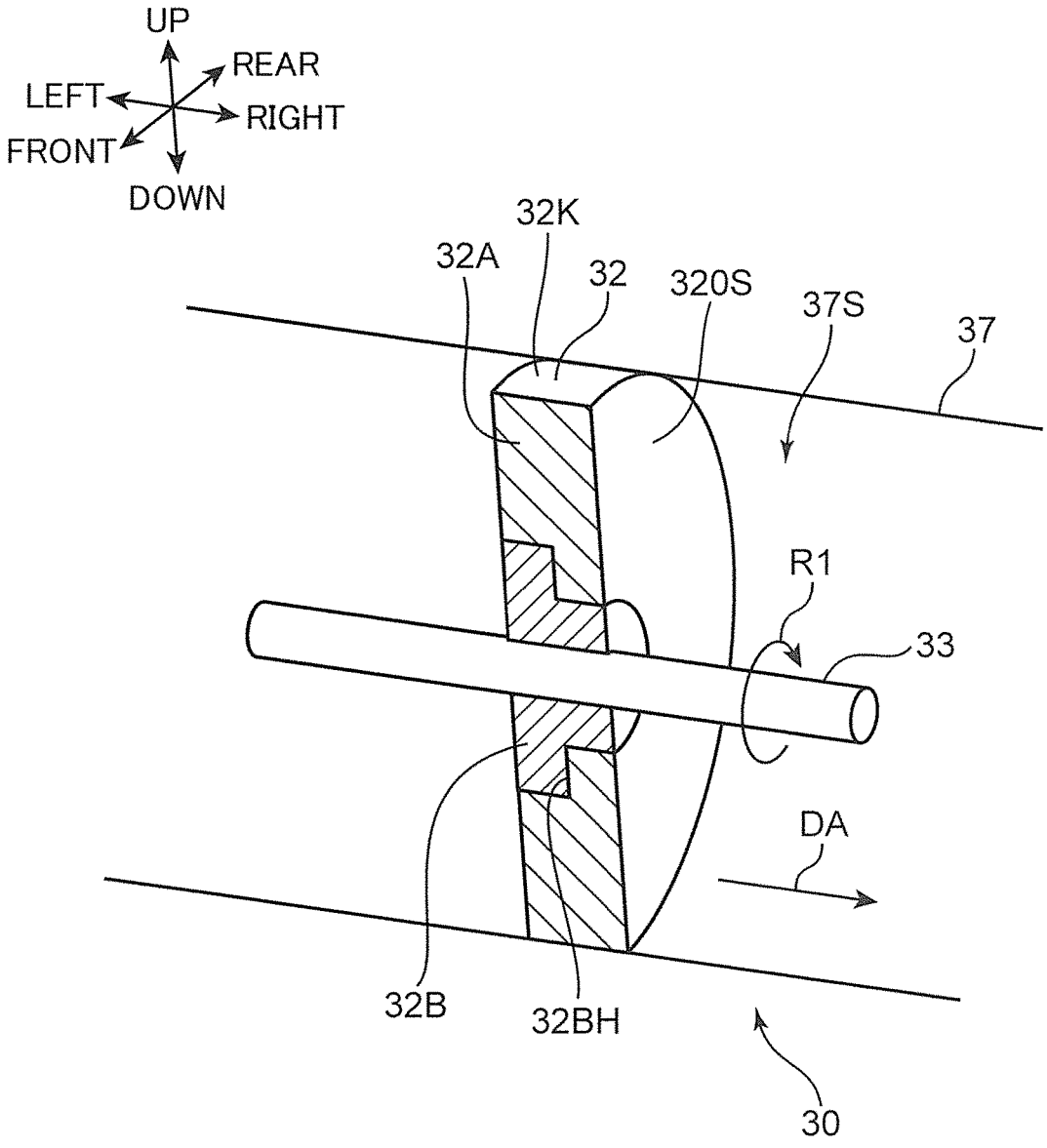
FIG. 12 is a schematic sectional perspective view of a moving wall of the developer storage container according to the embodiment of the present disclosure.
Figure 13:
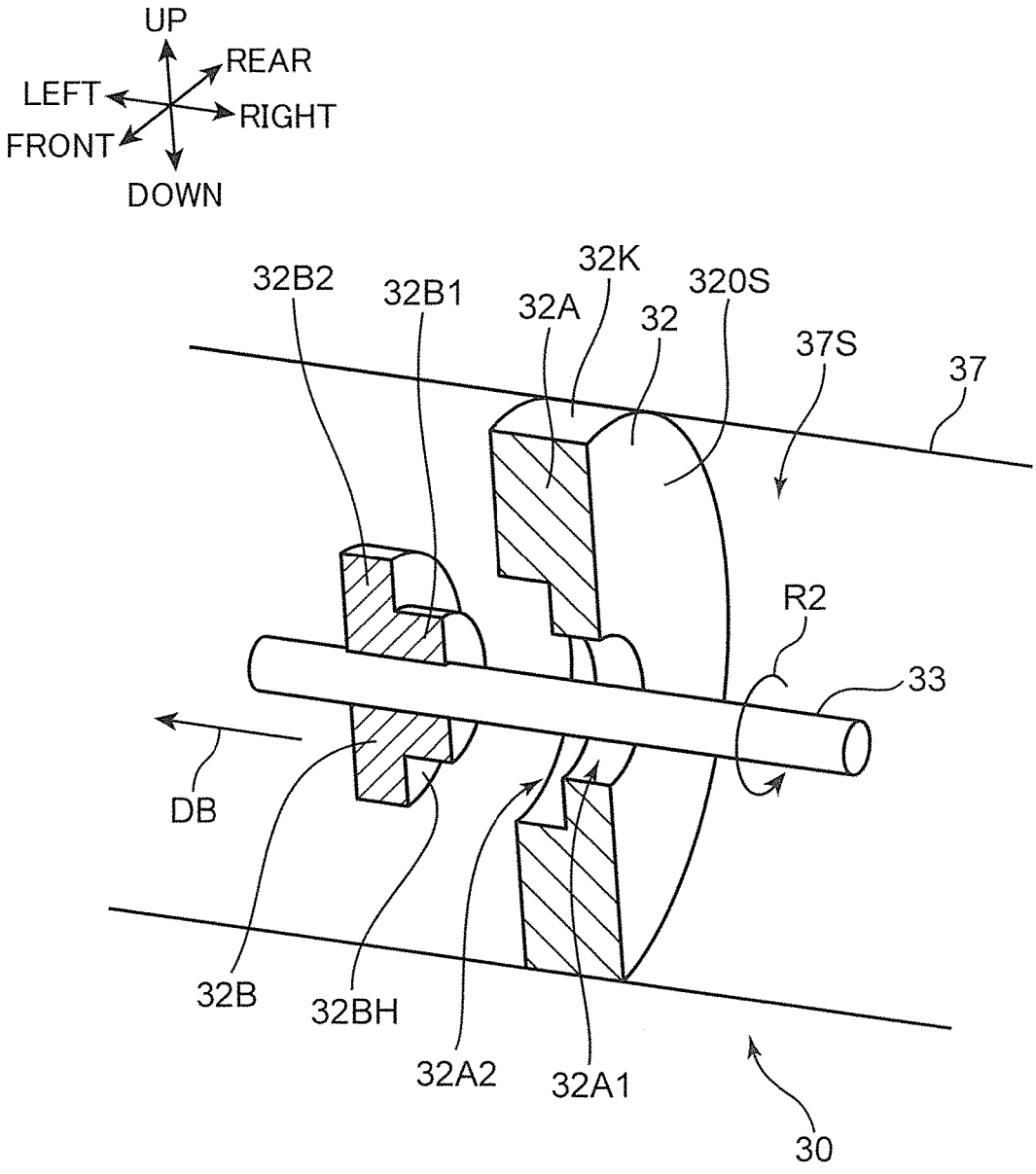
FIG. 13 is a schematic sectional exploded perspective view of the moving wall of the developer storage container according to the embodiment of the present disclosure.

FIG. 12 is a schematic sectional perspective view of the moving wall 32 according to this embodiment. FIG. 13 is a schematic sectional exploded perspective view of the moving wall 32. In this embodiment, the moving wall 32 has a separation structure as shown in FIGS. 12 and 13. Note that this separation structure is not shown in FIG. 9. With reference to FIGS. 12 and 13, the moving wall 32 includes a first wall portion 32A and a second wall portion 32B.

The first wall portion 32A constitutes an outer peripheral part of the moving wall 32. The first wall portion 32A has the outer peripheral surface 32K (first outer peripheral surface) and the conveying surface 320S described above. Further, the first wall portion 32A is formed with a small-diameter space 32A1 and a large-diameter space 32A2 (FIG. 13) (both are space portions) configured to allow the insertion of the shaft 33. The small-diameter space 32A1 and the large-diameter space 32A2 communicate in the first direction. Note that a tip part (downstream end part in the first direction) of the small-diameter space 32A1 is desirably sealed by an unillustrated ring-shaped seal member. The outer peripheral surface 32K of the first wall portion 32A is in contact with the inner peripheral surface 37K of the container body 37 via the inner wall seal 322 (FIG. 9).

The second wall portion 32B constitutes an inner peripheral part of the moving wall 32. The second wall portion 32B is shaped to be fitted into the small-diameter space 32A1 and the large-diameter space 32A2 of the first wall portion 32A. Specifically, the second wall portion 32B includes a small-diameter portion 32B1 and a large-diameter portion 32B2 upstream of the small-diameter portion 32B1 in the first direction. As shown in FIGS. 12 and 13, the small-diameter portion 32B1 is fittable into the small-diameter space 32A1, and the large-diameter portion 32B2 is fittable into the large-diameter space 32A2. Further, the second wall portion 32B includes the bearing portion 32J and the internally threaded portion 320D described above (FIG. 9). The shaft 33 is inserted through the bearing portion 32J, and the internally threaded portion 320D is arranged on the inner peripheral surface of the bearing portion 32J. Further, the second wall portion 32B includes a pressing portion 32BH (FIG. 13) for pressing the first wall portion 32A in the first direction.

Note that the small-diameter portion 32B1 and the large-diameter portion 32B2 may be circular or non-circular when viewed along the first direction. Further, an unillustrated seal member may be arranged in a contact part between the first and second wall portions 32A, 32B.

When the shaft 33 is rotated in a predetermined first rotating direction R1 (FIG. 12), the pressing portion 32BH presses the first wall portion 32A according to the engagement of the externally threaded portion 333 and the internally threaded portion 320D (FIG. 9), whereby the second wall portion 32B moves in the first direction integrally with the first wall portion 32A. Thus, the toner in the storage space 37S can be discharged through the toner discharge port 377. Note that the second wall portion 32B is held in close contact with the first wall portion 32A, whereby each of the first and second wall portions 32A. 32B can support the posture of the other. As a result, the moving wall 32 is held in a posture perpendicular to the shaft 33.

On the other hand, if the shaft 33 is rotated in a predetermined second rotating direction R2 (FIG. 13) opposite to the first rotating direction R1, the second wall portion 32B relatively moves to an upstream side in the first direction with respect to the first wall portion 32A (arrow DB of FIG. 13) according to the engagement of the externally threaded portion 333 and the internally threaded portion 320D. Thus, even if a user erroneously touches the second gear 382 (FIG. 9) and the shaft 33 is rotated in the second rotating direction R2, at least a movement of the first wall portion 32A of the moving wall 32 to the upstream side in the first direction is restrained. Therefore, a large change of a toner distributed state on a side downstream of the first wall portion 32A in the first direction is restrained, and stable discharge of the toner is maintained. As a result, an image can be stably formed on a sheet S. Note that this effect can be exhibited also when the user temporarily detaches the toner container 30 and sets the toner container 30 in such a posture as to extend along the vertical direction. Specifically, if the position of the first wall portion 32A in the first direction remains unchanged, the toner distributed state is substantially reproduced if the toner container 30 is set in a horizontal posture again in the printer 100.

Further, in this embodiment, the outer peripheral surface of the second wall portion 32B is arranged at a distance from and radially inwardly of the inner peripheral surface 37K of the container body 37. Specifically, only the outer peripheral surface of the first wall portion 32A, out of the moving wall 32, is in contact with the inner peripheral surface 37K via the inner wall seal 322. Thus, the moving wall 32 is compactly set and a load applied to the shaft 33 when the moving wall 32 moves is reduced as compared to a mode in which the outer peripheral surface of the second wall portion 32B is in contact with the inner peripheral surface 37K of the container body 37. Further, as shown in FIG. 12, a width of the moving wall 32 in the first direction can be set small by accommodating the second wall portion 32B radially inside the first wall portion 32A. At this time, the moving wall 32 can be more compactly set by arranging the pressing portion 32BH for pressing the first wall portion 32A utilizing a step portion between the small-diameter portion 32B1 and the large-diameter portion 32B2 of the second wall portion 32B.

Further, as described above, the volume replenishment type toner replenishment is adopted in this embodiment. Specifically, a toner replenishing operation from the toner container 30 to the developing device 20 is performed by the toner in the storage space 37S applying a pressure to the toner around the toner replenishing port 25. Since the toner distributed state on the side closer to the toner discharge port 377 than the moving wall 32 is not largely changed by the action of the first and second wall portions 32A, 32B, the toner is stably replenished into the development housing 210 of the developing device 20.

The printer 100 provided with the toner container 30 according to the embodiment of the present disclosure has been described above. On the other hand, the present disclosure is not limited to this and, for example, the following modifications can be adopted.

(1) Although a monochrome printer is described as the printer 100 in the above embodiment, the present disclosure is not limited to this. Particularly, if the printer 100 is a tandem color printer, respective toner containers 30 may be mounted from above into the housing 101 to be adjacent to each other in correspondence with a plurality of colors of toners after the access cover 100C (FIG. 2) of the printer 100 is opened.

(2) Further, although the moving wall 32 moves from the side of the lid portion 31 to the side of the right wall 375 in the above embodiment, the present disclosure is not limited to this. The toner discharge port 377 may be open on the side of the lid portion 31 and the moving wall 32 may move from the side of the right wall 375 to the side of the lid portion 31. Further, the opening position of the toner discharge port 377 is not limited to the above position. The toner discharge port 377 may be open in a lowermost part of the bottom portion 371 or may be open at another position.

(3) Further, although the volume replenishment type toner replenishing method is described in the above embodiment, the present disclosure is not limited to this. An unillustrated toner sensor may be provided also in the development housing 210 of the developing device 20 and the moving wall 32 may be moved to replenish the toner from the toner container 30 into the developing device 20 according to an output of this toner sensor. Further, the developing method of the developing device 20 is not limited to the one-component developing method, and a two-component developing method may be adopted.

Figure 14:
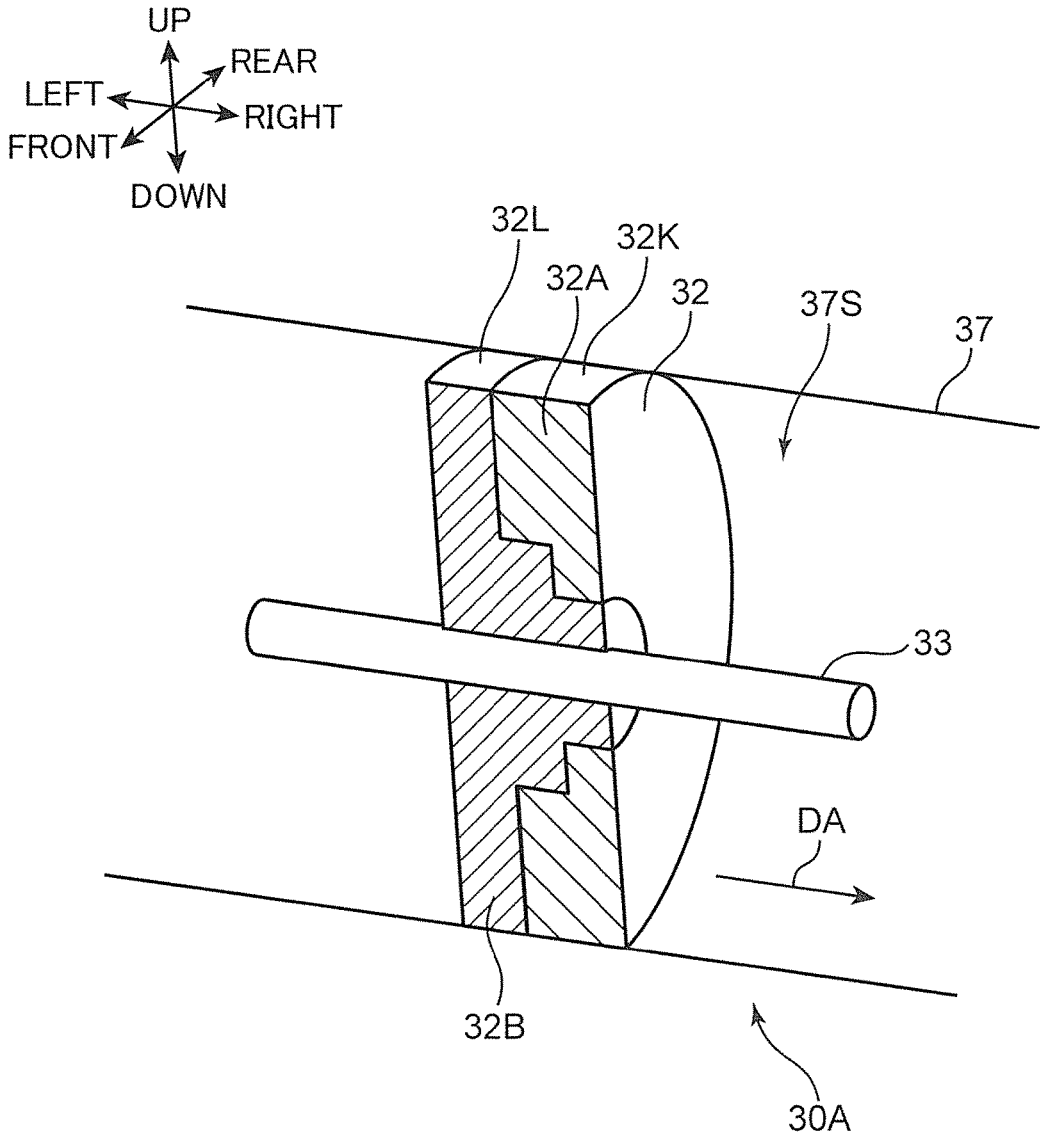
FIG. 14 is a schematic sectional exploded perspective view of the moving wall of the developer storage container according to a first modification of the present disclosure.
Figure 15:
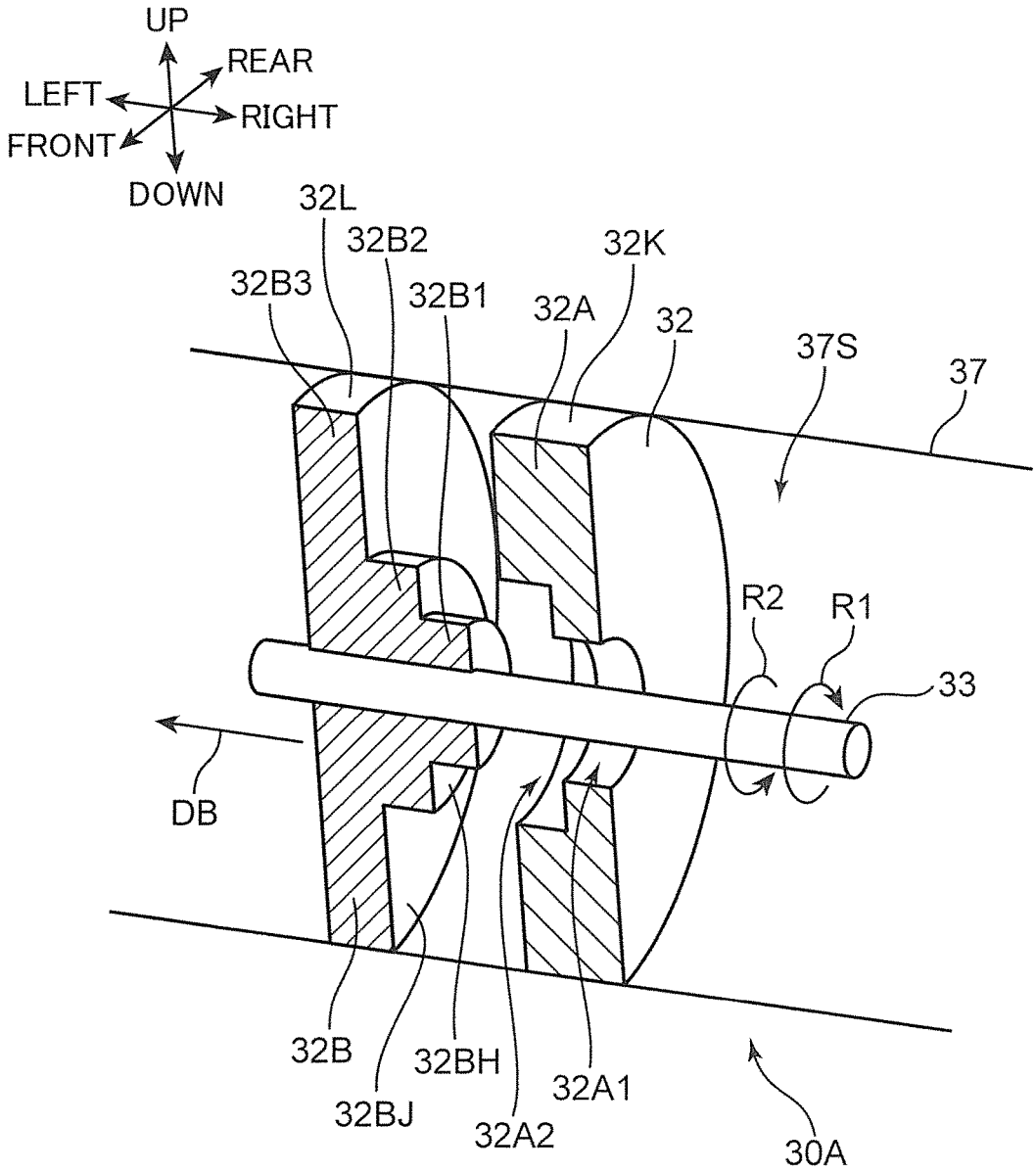
FIG. 15 is a schematic sectional exploded perspective view of a moving wall of a developer storage container according to the first modification of the present disclosure.

(4) FIG. 14 is a schematic sectional perspective view of a moving wall 32 of a toner container 30A according to a first modification of the present disclosure. FIG. 15 is a schematic sectional exploded perspective view of the moving wall 32 of the toner container 30A. As shown in FIG. 15, a second wall portion 32B may include an upstream wall portion 32B3 in addition to a small-diameter portion 32B1 and a large-diameter portion 32B2. The upstream wall portion 32B3 is arranged upstream of the large-diameter portion 32B2 in the first direction and has an even larger outer diameter than the large-diameter portion 32B2. Further, the upstream wall portion 32B3 includes an auxiliary pressing portion 32BJ and an outer peripheral surface 32L (second outer peripheral surface). The auxiliary pressing portion 32BJ can press a wall surface of a first wall portion 32A on an upstream side in the first direction. Further, the outer peripheral surface 32L is arranged in contact with an inner peripheral surface 37K of a container body 37 on a side upstream of an outer peripheral surface 32K of the first wall portion 32A in the first direction. Note that a seal member similar to the inner wall seal 322 may be arranged between the outer peripheral surface 32L and the inner peripheral surface 37K.

According to this configuration, if a shaft 33 is rotated in the first rotating direction R1 again after the second wall portion 32B moves to the upstream side in the first direction with respect to the first wall portion 32A, the second wall portion 32B easily moves in the first direction due to contact friction between the outer peripheral surfaces 32L and 32K. Thus, the second wall portion 32B is easily fitted into a small-diameter space 32A1 and a large-diameter space 32A2 of the first wall portion 32A.

Further, in addition to the pressing portion 32BH, the auxiliary pressing portion 32BJ presses the first wall portion 32A in the first direction in this modification. Thus, the moving wall 32 is easily kept in a posture perpendicular to the shaft 33 and a movement of the moving wall 32 is smoothly realized. Note that, as shown in FIGS. 14 and 15, the second wall portion 32B of the moving wall 32 is not limited to a three-step shape and may be shaped to have four or more steps. Further, the second wall portion 32B may have such a continuously tapered shape as if by having an infinite number of steps.

Figure 16:
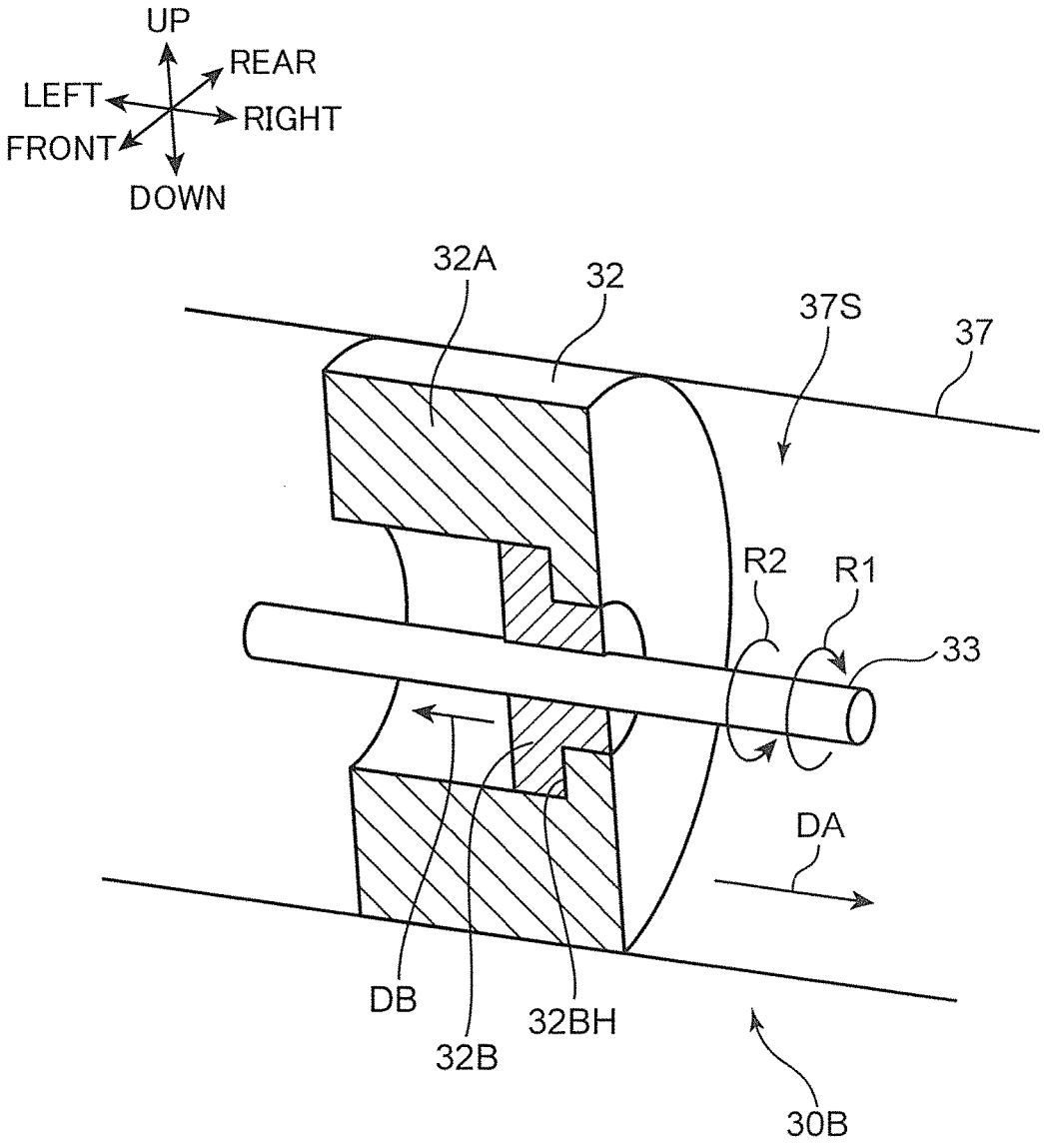
FIG. 16 is a schematic sectional perspective view of a moving wall of a developer storage container according to a second modification of the present disclosure.

FIG. 16 is a schematic sectional perspective view of a moving wall 32 of a toner container 30B according to a second modification of the present disclosure. In FIG. 16, a first wall portion 32A extends longer leftward (upstream side in the first direction) than a second wall portion 32B as compared to FIG. 12. In the case of such a configuration, even if a shaft 33 is erroneously rotated in the second rotating direction R2, the second wall portion 32B moves to the upstream side in the first direction in the hollow cylindrical interior of the first wall portion 32A. Thus, if the shaft 33 is rotated in the first rotating direction R1 again, the second wall portion 32B moves in the first direction inside the first wall portion 32A. Thus, the first and second wall portions 32A. 32B are smoothly fitted. Note that, in FIG. 16, the outer peripheral surface of the second wall portion 32B is desirably in contact with the inner peripheral surface of the first wall portion 32A in a radial direction.

Figure 17:
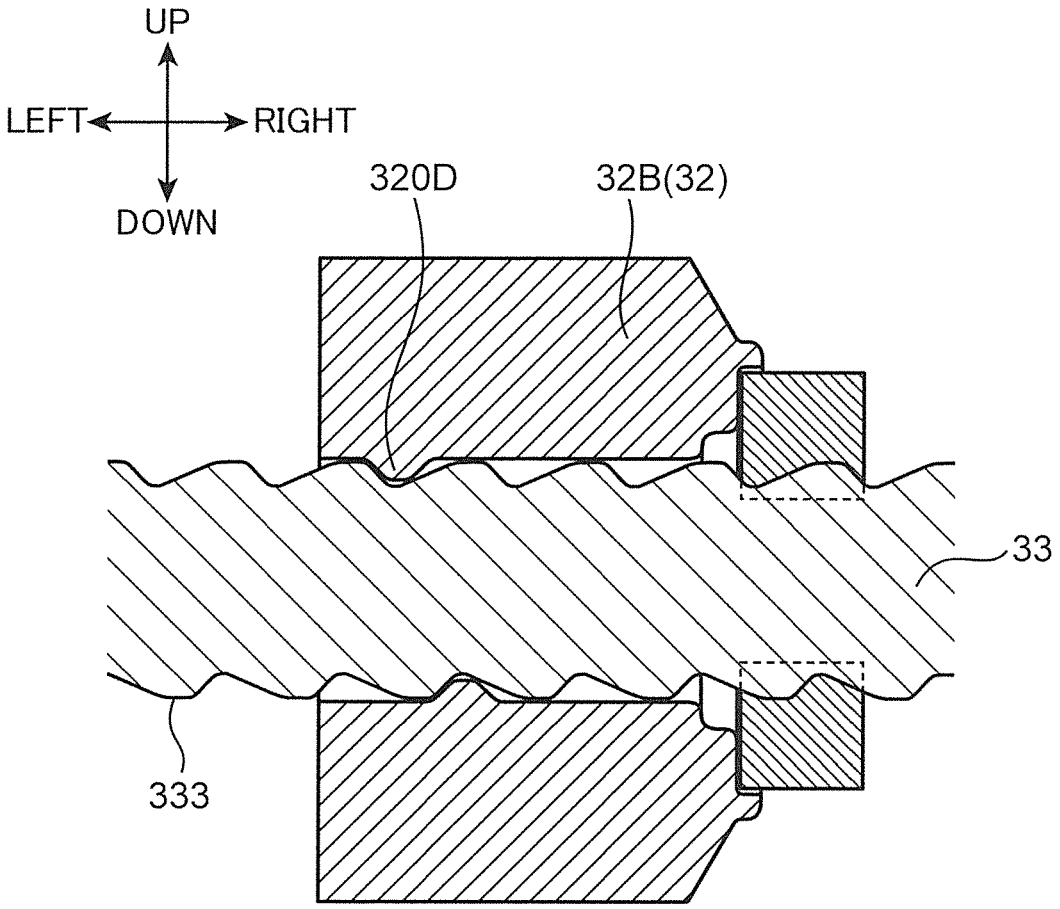
FIG. 17 is a sectional view of a bearing portion of a moving wall of a developer storage container according to a third modification of the present disclosure.
Figure 18:
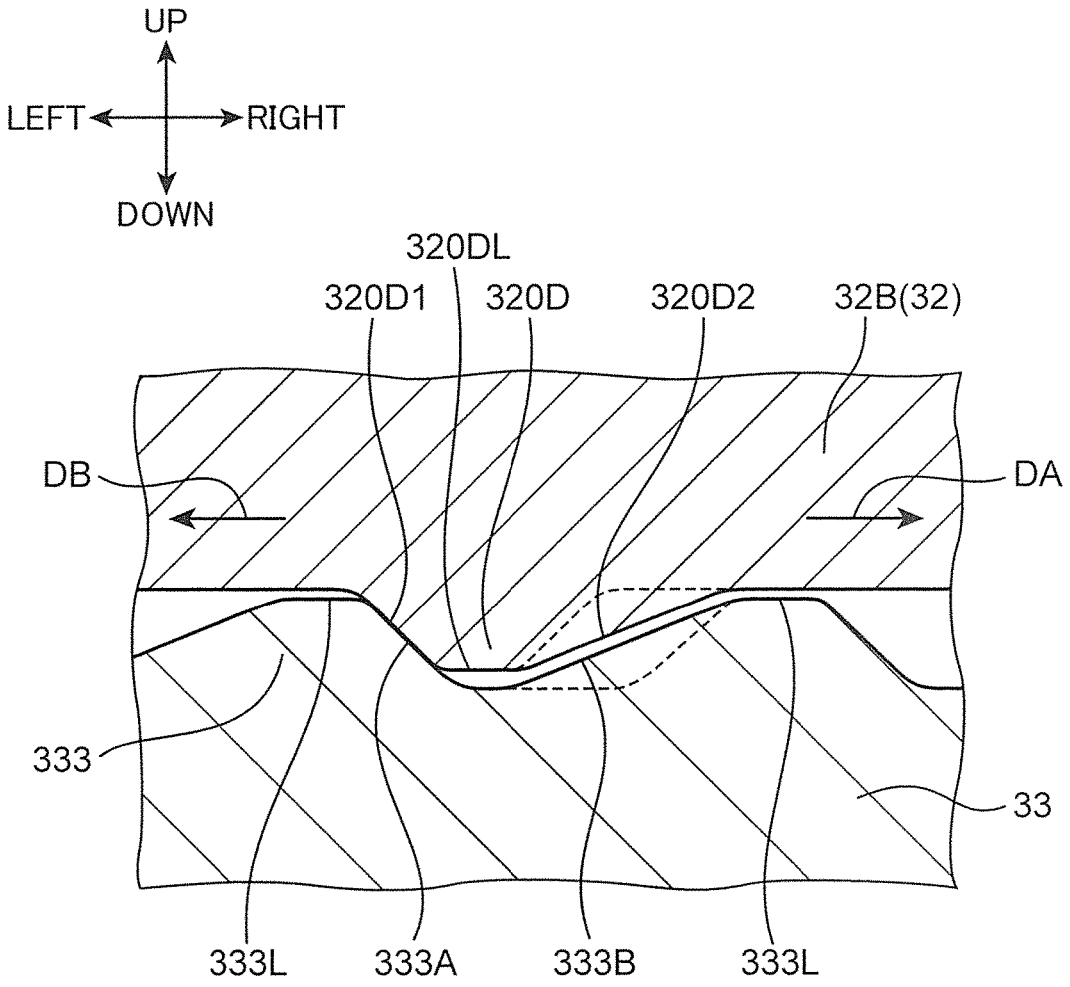
FIG. 18 is an enlarged sectional view of the bearing portion of the moving wall of the developer storage container according to the third modification of the present disclosure.

FIG. 17 is a sectional view of a bearing portion of a moving wall of a toner container according to a third modification of the present disclosure. FIG. 18 is an enlarged sectional view of the bearing portion. This modification is characterized by the shapes of a thread of an externally threaded portion 333 and a thread of an internally threaded portion 320D. Specifically, with reference to FIG. 18, the externally threaded portion 333 has a first male slope 333A (first inclined surface) and a second male slope 333B (second inclined surface).

The first male slope 333A is formed by an inclined surface arranged downstream (DA) of a ridge 333L of the externally threaded portion 333 in the first direction and inclined to taper the externally threaded portion 333 in the first direction. Further, the second male slope 333B is formed by an inclined surface arranged upstream of the ridge 333L of the externally threaded portion 333 in the first direction and inclined to widen the externally threaded portion 333 in the first direction, in other words, on a side opposite to the first male slope 333A. Further, the second male slope 333B is more gently inclined with respect to the first direction than the first male slope 333A.

Further, the internally threaded portion 320D has a first female slope 320D1 (third inclined surface) and a second female slope 320D2 (fourth inclined surface).

The first female slope 320D1 is formed by an inclined surface arranged upstream of a ridge 320DL of the internally threaded portion 320D in the first direction and inclined to widen the internally threaded portion 320D in the first direction. The second female slope 320D2 is formed by an inclined surface arranged downstream of the ridge 320DL of the internally threaded portion 320D in the first direction and inclined to taper the internally threaded portion 320D in the first direction, in other words, on a side opposite to the first female slope 320D1. Further, the second female slope 320D2 is more gently inclined with respect to the first direction than the first female slope 320D1.

According to this configuration, a rotational torque applied to the shaft 33 according to the engagement of the first male slope 333A of the shaft 33 and the first female slope 320D1 of the internally threaded portion 320D when the shaft 33 is rotated in the first rotating direction (R1) is larger than a rotational torque applied to the shaft 33 according to the engagement of the second male slope 333B of the externally threaded portion 333 and the second female slope 320D2 of the internally threaded portion 320D when the shaft 33 is rotated in the second rotating direction (R2). The externally threaded portion 333 is at the same pitch regardless of whether the shaft 33 is rotated in the first rotating direction or in the second rotating direction. However, in the case of rotation in the second rotating direction, a component in a radial direction of a force generated by the contact of the second male slope 333B and the second female slope 320D2 is large, wherefore a large torque is generated for the shaft 33. Accordingly, even if a user erroneously rotates the shaft 333, a load for this rotation becomes large and a movement amount of the second wall portion 32B can be made small. Therefore, the first and second wall portions 32A, 32B are easily fitted again manually or according to the rotation of the shaft 33. Note that the structure according to this modification may be applied to each previous embodiment.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer storage container, comprising:

a container body having an inner peripheral surface defining a tubular internal space extending along a first direction, the container body being formed with a developer discharge port open to communicate with the internal space and allowing a developer to be discharged;

a moving wall configured to move in the first direction in the internal space while conveying the developer in the internal space toward the developer discharge port; and a shaft arranged to extend in the first direction in the internal space and rotatably supported in the container body, the shaft including a first engaging portion spirally formed along the first direction on an outer peripheral surface;

wherein the moving wall includes:

a first wall portion having a first outer peripheral surface arranged in contact with the inner peripheral surface of the container body and a conveying surface defining a storage space for storing the developer together with the inner peripheral surface of the container body, the first wall portion being formed with a space portion allowing the insertion of the shaft; and a second wall portion to be fitted into the space portion of the first wall portion, the second wall portion including a bearing portion configured such that the shaft is inserted therethrough, a second engaging portion arranged on an inner peripheral surface of the bearing portion and engageable with the first engaging portion, and a pressing portion configured to press the first wall portion in the first direction, the second wall portion moving in the first direction integrally with the first wall portion by the pressing portion pressing the first wall portion according to the engagement of the first and second engaging portions when the shaft is rotated in a first rotating direction, the second wall portion relatively moving to an upstream side in the first direction with respect to the first wall portion according to the engagement of the first and second engaging portions when the shaft is rotated in a second rotating direction opposite to the first rotating direction.

2. A developer storage container according to claim 1, wherein:

an outer peripheral surface of the second wall portion is arranged at a distance from and radially inwardly of the inner peripheral surface of the container body.

3. A developer storage container according to claim 1, wherein:

the second wall portion has a second outer peripheral surface arranged in contact with the inner peripheral surface of the container body on a side upstream of the first outer peripheral surface in the first direction.

4. A developer storage container according to claim 1, wherein:

the first engaging portion includes:

a first inclined surface inclined to taper the first engaging portion in the first direction; and a second inclined surface inclined to widen the first engaging portion in the first direction on a side opposite to the first inclined surface, the second inclined surface being more gently inclined than the first inclined surface;

the second engaging portion includes:

a third inclined surface inclined to widen the second engaging portion in the first direction; and a fourth inclined surface inclined to taper the second engaging portion in the first direction on a side opposite to the third inclined surface, the fourth inclined surface being more gently inclined than the third inclined surface; and a rotational torque applied to the shaft according to the engagement of the first inclined surface of the first engaging portion and the third inclined surface of the second engaging portion when the shaft is rotated in the first rotating direction is larger than a rotational torque applied to the shaft according to the engagement of the second inclined surface of the first engaging portion and the fourth inclined surface of the second engaging portion when the shaft is rotated in the second rotating direction.

5. An image forming apparatus, comprising:

a developer storage container according to claim 1;

an image carrier configured such that an electrostatic latent image is formed on a surface and a developer image is carried thereon;

a developing device configured to have the developer replenished thereinto from the developer storage container and supply the developer to the image carrier; and a transfer unit configured to transfer the developer image from the image carrier to a sheet.

6. An image forming apparatus according to claim 5, wherein the developing device includes:

a housing having a developer conveyance path configured such that the developer is conveyed in a predetermined conveying direction therein;

a developer replenishing port open in the housing below the developer discharge port and configured to receive the developer from the developer storage container into the developer conveyance path;

a developer conveying member arranged in the developer conveyance path and configured to convey the developer in the conveying direction; and a conveying ability suppressing portion configured to partially suppress a conveying ability of the developer conveying member to convey the developer in the conveying direction on a side downstream of the developer replenishing port in the conveying direction.

* * * * *